US010071828B2

(12) United States Patent
Moncrief et al.

(10) Patent No.: US 10,071,828 B2
(45) **Date of Patent: *Sep. 11, 2018**

(54) SYSTEM AND METHOD FOR PACKAGING OF NESTED PRODUCTS

(71) Applicant: GRAPHIC PACKAGING INTERNATIONAL, INC., Atlanta, GA (US)

(72) Inventors: Frank N. Moncrief, Acworth, GA (US); David F. Warner, Keenesaw, GA (US); Colin Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 632 days.

This patent is subject to a terminal disclaimer.

(21) Appl. No.: 14/254,028

(22) Filed: Apr. 16, 2014

(65) Prior Publication Data

US 2014/0311091 A1 Oct. 23, 2014

Related U.S. Application Data

(60) Provisional application No. 61/854,154, filed on Apr. 17, 2013.

(51) Int. Cl.
*B65B 21/24* (2006.01)
*B65B 51/02* (2006.01)
(Continued)

(52) U.S. Cl.
CPC ..... *B65B 21/242* (2013.01); *B65B 5/024* (2013.01); *B65B 35/405* (2013.01); *B65B 51/02* (2013.01); *B65B 7/20* (2013.01); *B65B 43/265* (2013.01)

(58) Field of Classification Search
CPC ..... B65B 5/024; B65B 35/405; B65B 51/02; B65B 7/20; B65B 43/265; B65B 21/242
(Continued)

(56) References Cited

U.S. PATENT DOCUMENTS 2,678,151 A 5/1954 Geisler
3,007,293 A * 11/1961 McGihon ..... B65B 11/004 493/151
(Continued)

FOREIGN PATENT DOCUMENTS

EP 0552981 A1 * 7/1993 ..... B65B 21/242
JP 53-102188 9/1978
(Continued)

OTHER PUBLICATIONS

First Examination Report for NZ 712618 dated Jul. 20, 2016.
(Continued)

*Primary Examiner* — Michelle Lopez
*Assistant Examiner* — Lucas Palmer
(74) *Attorney, Agent, or Firm* — Womble Bond Dickinson (US) LLP

(57) ABSTRACT

A packaging system for the selection, grouping and loading of varying size and/or configuration product packs into cartons as provided. The packaging system includes a selection area having a primary selector for forming an initial product pack configuration, and a secondary selector adapted to select and direct an additional grouping of products into a nested arrangement against the initial product pack so as to form a nested product pack. The nested product packs thereafter can be engaged by loader arms of a pair of opposed loading assemblies, which move the nested product packs into a series of cartons moving through the packaging machine. Thereafter, the ends of the cartons can be closed and sealed to complete the packaging of the product packs therein.

7 Claims, 33 Drawing Sheets

(51) Int. Cl.

| | |
|---|---|
| ***B65B 35/40*** | (2006.01) |
| ***B65B 5/02*** | (2006.01) |
| *B65B 7/20* | (2006.01) |
| *B65B 43/26* | (2006.01) |

(58) Field of Classification Search
USPC ..... 53/443
See application file for complete search history.

(56) References Cited

U.S. PATENT DOCUMENTS

| | | | | |
|---|---|---|---|---|
| 3,022,615 | A * | 2/1962 | Schroeder | B65B 5/024 53/458 |
| 3,139,714 | A * | 7/1964 | Hall | B65B 5/061 53/252 |
| 3,778,959 | A * | 12/1973 | Langen | B65B 21/08 198/419.3 |
| 3,815,316 | A * | 6/1974 | Brooke | B65B 5/061 53/157 |
| 3,956,868 | A * | 5/1976 | Ganz | B31B 1/06 53/154 |
| 4,250,693 | A | 2/1981 | Andersson | |
| 4,463,541 | A * | 8/1984 | Nowacki | B65B 11/004 53/207 |
| 4,693,055 | A * | 9/1987 | Olsen, Jr. | B65B 21/06 198/418.1 |
| 4,756,139 | A * | 7/1988 | Le Bras | B65B 21/242 53/398 |
| 4,887,414 | A * | 12/1989 | Arena | B65B 21/24 198/418.7 |
| 4,962,625 | A | 10/1990 | Johnson, Jr. | |
| 4,982,551 | A * | 1/1991 | Nigrelli, Sr. | B65B 5/06 53/251 |
| 5,027,586 | A * | 7/1991 | Ramaker | B65B 35/54 493/316 |
| 5,052,544 | A * | 10/1991 | Anderson | B65G 47/841 198/456 |
| 5,241,806 | A * | 9/1993 | Ziegler | B65B 35/405 53/237 |
| 5,388,389 | A | 2/1995 | Tisma | |
| 5,456,058 | A * | 10/1995 | Ziegler | B65B 5/106 53/157 |
| 5,477,655 | A * | 12/1995 | Hawley | B65B 35/405 53/251 |
| 5,501,064 | A * | 3/1996 | Ingram | B65B 35/54 53/252 |
| 5,502,950 | A * | 4/1996 | Moncrief | B65B 35/54 53/251 |
| 5,546,734 | A * | 8/1996 | Moncrief | B65B 5/106 198/433 |
| 5,553,441 | A | 9/1996 | Ivansco, Jr. et al. | |
| 5,606,848 | A * | 3/1997 | Domino | B65B 21/04 53/251 |
| 5,727,365 | A * | 3/1998 | Lashyro | B65B 5/024 53/157 |
| 5,758,474 | A * | 6/1998 | Ziegler | B65B 5/106 53/153 |
| 5,771,658 | A * | 6/1998 | Olson | B65B 35/50 53/152 |
| 5,775,067 | A * | 7/1998 | Hawley | B65B 21/06 198/418.2 |
| 5,809,746 | A | 9/1998 | DePuy | |
| 5,896,728 | A * | 4/1999 | Domino | B65B 43/365 53/252 |
| 6,058,679 | A | 5/2000 | Ziegler et al. | |
| 6,105,338 | A * | 8/2000 | Kalany | B65B 35/405 198/475.1 |
| 6,202,392 | B1 | 3/2001 | Greenwell | |
| 6,209,706 | B1 | 4/2001 | Tod, Jr. | |
| 6,279,301 | B1 * | 8/2001 | Corniani | B65B 49/10 493/80 |
| 6,308,502 | B1 | 10/2001 | Olson et al. | |
| 6,711,878 | B1 * | 3/2004 | Paselsky | B65B 5/106 53/237 |
| 6,907,979 | B2 | 6/2005 | Ford et al. | |
| 7,073,656 | B2 | 7/2006 | Gust et al. | |
| 7,104,027 | B2 | 9/2006 | Ford et al. | |
| 7,146,784 | B1 * | 12/2006 | Portrait | B65B 5/024 493/55 |
| 7,240,467 | B2 | 7/2007 | Moncrief et al. | |
| 7,316,103 | B2 | 1/2008 | Ford | |
| 7,392,894 | B2 * | 7/2008 | Jacob | B65B 21/04 198/419.3 |
| 7,395,915 | B2 * | 7/2008 | Culpepper | B65B 5/024 198/419.2 |
| 7,503,157 | B2 | 3/2009 | Ford | |
| 7,503,447 | B2 | 3/2009 | Ford | |
| 7,533,768 | B2 | 5/2009 | Floding et al. | |
| 7,637,083 | B2 | 12/2009 | Moncrief et al. | |
| 7,726,464 | B2 | 6/2010 | Cerf | |
| 7,832,186 | B2 | 11/2010 | Moncrief et al. | |
| 8,015,776 | B2 | 9/2011 | Alfonso et al. | |
| 8,074,430 | B2 | 12/2011 | Disrud | |
| 8,235,201 | B2 | 8/2012 | Miller et al. | |
| 8,246,290 | B2 | 8/2012 | May et al. | |
| 8,596,446 | B2 | 12/2013 | Biggel et al. | |
| 8,646,592 | B1 | 2/2014 | Liao | |
| 8,695,781 | B2 | 4/2014 | Mougin et al. | |
| 2007/0277480 | A1 * | 12/2007 | Ford | B65B 5/068 53/443 |
| 2008/0000753 | A1 * | 1/2008 | Patterson | B65B 35/405 198/370.02 |
| 2008/0011581 | A1 * | 1/2008 | Ford | B65G 17/005 198/348 |
| 2008/0104933 | A1 * | 5/2008 | Flagg | B65B 35/405 53/493 |
| 2010/0018156 | A1 | 1/2010 | Ford | |
| 2010/0162668 | A1 * | 7/2010 | Cain | B65B 5/06 53/475 |
| 2011/0173930 | A1 | 7/2011 | Poutot | |
| 2011/0173931 | A1 * | 7/2011 | Ford | B65B 5/04 53/473 |
| 2012/0096808 | A1 * | 4/2012 | Poutot | B65B 21/242 53/235 |
| 2013/0097974 | A1 * | 4/2013 | Disrud | B65B 11/105 53/473 |
| 2014/0061000 | A1 * | 3/2014 | Ford | B65G 47/8823 198/419.1 |
| 2015/0329231 | A1 * | 11/2015 | Moncrief | B65B 59/005 53/443 |

FOREIGN PATENT DOCUMENTS

| | | |
|---|---|---|
| JP | 9-500347 | 1/1997 |
| JP | 9-507460 | 7/1997 |
| JP | 2009-543743 | 12/2009 |
| JP | 2011-526869 | 10/2011 |
| WO | WO 94/20368 | 9/1994 |
| WO | WO 97/46450 | 12/1997 |

OTHER PUBLICATIONS

International Search Report and Written Opinion for PCT/US2014/034280 dated Aug. 25, 2014.
International Search Report and Written Opinion for PCT/US2016/041285 dated Oct. 18, 2016.
Notification of Reasons for Refusal for Japanese Application No. 2016-509043 dated Nov. 25, 2016, with translation.
Notification of Reasons for Refusal for Japanese Application No. 2016-509043 dated Jun. 29, 2017, with translation.

* cited by examiner

SYSTEM AND METHOD FOR PACKAGING OF NESTED PRODUCTS

CROSS REFERENCE TO RELATED APPLICATIONS

The present Patent Application is a formalization of previously filed, U.S. Provisional Patent Application Ser. No. 61/854,154, filed Apr. 17, 2013 by the inventors named in the present Application. This Patent Application claims the benefit of the filing date of this cited Provisional Patent Application according to the statutes and rules governing provisional patent applications, particularly 35 U.S.C. § 119(a)(i) and 37 C.F.R. § 1.78(a)(4) and (a)(5). The specification and drawings of the Provisional Patent Application referenced above are specifically incorporated herein by reference as if set forth in their entirety.

FIELD OF THE INVENTION

The present invention generally relates to packaging of various articles such as bottles, cans or other products within cartons, and in particular to the selection and loading of nested groups of products into a carton with the nested groups of products being controlled as they are loaded into the cartons and the ends of the cartons are folded and sealed.

BACKGROUND OF THE INVENTION

It is common for products, such as bottles, cans, bags, etc., to be selected into predefined product groupings and loaded into cartons for packaging of such products in sets or "packs" for transport and sale. For example, it is commonplace for soft drinks, beer and other food or drink products contained within cans or bottles to be packaged in paperboard cartons such as in 6, 12, 20 and/or 24 packs for sale to the end consumers. Typically, the bottles or cans will be fed into a packaging machine where they will be grouped into the desired sets or product packs, i.e., groups of 6, 12, 20, 24, etc., after which each group of bottles or cans will be loaded into or onto a carton. The cartons can comprise paperboard sleeves, although flat blank style cartons also can be used, with the selected product groupings generally being urged or otherwise moved into the interior of such carton sleeves through one open end thereof. Thereafter, the ends of the cartons will be folded and glued in place to create a sealed package.

Traditionally, products such as soft drinks and beer have been sold in packs of 6, 12 and 24 bottles or cans, thus providing consumers limited choices in the number of pre-packaged products available for purchase. Recently, as consumer tastes and preferences have changed, consumer demand for more variety in available package sizes has increased. In response to consumer demands for more and/or different sized product offerings, manufacturers are now developing and offering a wider variety of portion size containers, such as 6, 8, or 20 bottles or cans and/or half liter and 1 liter sizes as well. As a result, there is a growing need and demand for a much wider variety of package options than the traditional 6, 12 and 24 pack packages.

While consumers are looking for more options in terms of product pack sizes, it is, however, still desirable that such product packages remain as compact as possible so as to fit within refrigerators or on shelves with a minimal amount of space required or being taken up by such packages. In addition, such non-traditional size packages often require new, non-uniform size/shape carton constructions that can create a variety of issues in the selection, loading and packaging of such differing size groups of products therein. While attempts have been made to form packages having non-traditional product groupings, for example, groupings of 8 or 16 bottles, such systems generally have been forced to operate at slower production rates and have been inflexible in terms of the sizes and configurations of the cartons that can be packaged therein, typically being limited to use with a specific package size.

Accordingly, it can be seen that a need exists for a system and method for packaging products in a variety of different, non-traditional product groupings which addresses the foregoing and other related and unrelated problems in the art.

SUMMARY OF THE INVENTION

Briefly described, the present invention generally relates to a packaging system and method of operation of such packaging system adapted to enable the selection and grouping of nested product groupings of varying sizes and/or configurations and for loading such product groups or packs into a series of cartons moving along a carton path through the packaging system, after which the cartons can be enclosed and sealed. The present system provides flexibility in its operation so as to accommodate the selection and packaging of a variety of different size and/or configuration product groupings, including non-traditional pack sizes and "nested" or staggered product groups or packs. For example, the packaging system of the present invention can be adapted to package bottles, cans or other, similar products/articles in configurations ranging from conventional 2×3-6 packs, 2×6-12 packs, 3×4-12 packs, 4×5-20 packs, and 4×6-24 packs to more non-traditional packs such as 2×5-10 packs, 3×5-15 packs, 4×8-32, and larger packs, as well as enabling the selection, grouping and packaging of nested product groupings or staggered product arrangements, including the formation of 8, 10, 14, 18, 22 and 26 packs and other, varying sizes and/or configurations of packages and/or product groupings.

In one embodiment, the packaging system will include an infeed area upstream from a product selection and grouping area at which the products, for example cans or bottles, will be formed into product groups or packs of a desired size and configuration. The products can be fed along a first path of travel into the product selection and grouping area by a product conveyor, with an initial or first series of the products being separated into lines or lanes by a first or primary selector. If needed, any remaining products can be engaged by a secondary selector located downstream from the first or primary selector. To form a staggered or nested pack configuration, the first series of products, i.e., 2-7 rows of products will be selected and fed via the lanes of the primary selector to a product selector conveyor to form an initial product grouping within a pack reducing flight of the selector conveyor. An additional series of products, i.e., one, two, three, four or more products, can be fed through the lanes of the downstream secondary selector into a position abutting and engaging the initial product grouping to form the product pack. The formed product pack is thereafter carried by the pack reducing flight into the loading area or station whereupon the product pack is engaged from a loading side thereof by a loader arm of a first or primary loading assembly.

As the loader arm of the primary loading assembly urges the product pack across its pack reducing flight of the selector conveyor, the product pack can be engaged by a movable compression plate. The compression plate can be positioned along an upstream or downstream edge of the pack reducing flight and is moved toward an opposed plate of the pack reducing flight to apply a compression or urging force against the product pack. This movement/compression force applied by the compression plate against the nested product pack helps reduce and tighten the spacing between the products of the nested product pack, and at the same time can help stabilize and guide the product pack as it is inserted into the open end of a corresponding carton.

As the product packs are being formed, the cartons generally are fed by a carton feeder onto a carton conveyor extending through the packaging system. The cartons will be placed within flights or between lugs of the carton conveyor and further can be engaged by an overhead lug conveyor for erecting the cartons into open ended sleeves. The carton sleeves thereafter will be moved in timed relation with an associated or corresponding selector conveyor flights for receiving a nested product pack therein.

As the product packs are moved into their respective cartons from the loading side of the packaging system, a secondary or stabilizer side loader arm can be moved through the opposite open end of the carton into engagement with the product pack so that the product pack is engaged and stably held between the loader arms of the primary and secondary loading assemblies. For loading nested product packs, the pusher faces of the loader arms can have a substantially U- or C-shaped configuration whereby the additional, nested products added to the product pack by the secondary selector will be held in a stabilized alignment as the nested product packs are inserted into the cartons. Additional, alternative pusher face configurations such as a substantially cross-shaped, A-shaped, or other pusher face designs, also can be used. Still further, the selector wedges of the secondary selector can be changed to provide for varying selector wedge configurations as needed for selecting an additional series of one, two, three, four, or more products for feeding to the cartons as needed to form the desired size and/or configuration of nested product packs or other staggered product arrangements.

The opposing loader arms of the primary and secondary loading assemblies generally are moved into and out of the cartons along a pitched or phased path of movement whereby the loader arms initially are moved toward each other as the nested product pack is moved into a loaded position within a carton and thereafter are moved in a generally synchronized movement across the carton with the nested product pack engaged therebetween so as to stably and securely convey the product pack into a loaded position within its associated carton. As the product pack is loaded or seated within its carton, the cartons will be moved toward/into a folding/sealing zone or area of the packaging system wherein the end flaps of the cartons will be tucked and/or folded to a closed position and an adhesive applied to seal the cartons.

As the cartons enter the folding/sealing area of the packaging system, lower end flap portions of the carton along the stabilizing side thereof can be engaged by a first or upstream folding/tucking mechanism, which folds the lower end flaps of the cartons toward their closed positions. The loader arm of the secondary loading assembly can be maintained in engaging contact with the product pack within the carton as the lower end flaps are folded. The leading lower end flap along the upstream side of the carton can be engaged and urged toward their closed position by a series of lower guide rails mounted adjacent to the path of travel of the cartons. At substantially the same time, a gusset between the leading lower end flaps can be engaged and moved to an inward, tucked position by a rotating tucking device, while the trailing gusset and lower end flap can be similarly engaged and moved to their tucked and folded positions.

As the loaded cartons continue along their path of travel, the loader arms of the primary and secondary loading assemblies are fully retracted from the cartons, after which the cartons can be engaged by downstream folding and tucking mechanisms on both sides of the cartons. The top, upper and/or side end flaps on both sides of the cartons and the lower end flaps on the loading side of the cartons thus will be folded into their closed positions, with the bottom end flaps of the cartons further being folded over or beneath the top end flaps. An adhesive or glue material further can be applied to seal the end flaps of the cartons in their closed positions. The upper surfaces of the cartons also can be engaged by a control belt adjacent their loading ends, which belt can apply a desired compression force thereto to help provide additional stability to the products of the product packs adjacent the loading ends of the cartons as the loader arm of the primary or loading side loading assembly is moved out of engagement therewith, until the end flaps along the loading side of the carton can be folded/closed.

The enclosed cartons then can be moved through a compression section in which the cartons are engaged by compression belts to help seal the ends of the cartons in their closed configuration. The cartons also can be engaged by punches or other actuators to activate the series of article protection features that further can be provided along the bottom panels of the cartons. For example, if a series of bottles are being packaged within the cartons, fins, tongues or other projections can be formed within the cartons as needed to define article protection features separating the bottles or other fragile articles sufficient to reduce the amount of direct physical contact therebetween and assist in avoidance of breakage during handling and transport of the cartons. Thereafter, the cartons can be removed from the packaging system for collection for storage and/or transport.

In addition, for larger product packages, such as, for example, 20, 22, 24, 26, 28, 30, 32, and/or 34-36 packs, or larger packages, for which it may be desirable to provide additional product protection features along a center line thereof, the product packages can be fed into a turner/divider station, in which the product packages can be rotated, for example by approximately 90°, and/or also divided into multiple lanes for ease of storage of collection. The turner/divider station can be mounted at the end of the packaging system for receiving the cartons directly, or can be provided as a stand-alone, separate system in which the carton can be fed individually, as needed or desired.

As the cartons are fed into the turner/divider station, they can be engaged by an overhead turning mechanism. The overhead turning mechanism can include a series of turning arms that engage the upper surface of each carton. The turning arms generally can include the downwardly projecting portions or lugs to engage in upstream or downstream side surfaces of the cartons, respectively, and generally will be mounted to a support plate having a cam follower linked thereto. The cam followers engage and move along a cam track, causing the turning arms to be rotated, which correspondingly causes rotation of the cartons by approximately 90°. Once the cartons have been rotated, they can be engaged by a series of punches or other actuators for activating the article protection features extending along the center line of the cartons as needed. The cartons thereafter can be turned again and can be divided into multiple lanes or lines for collection and storage.

Various features, objects, advantages and aspects of the present invention further may be set forth or will become apparent to those skilled in the art upon consideration of the following detailed description, when taken in conjunction with the accompanying drawings.

Figure 1:
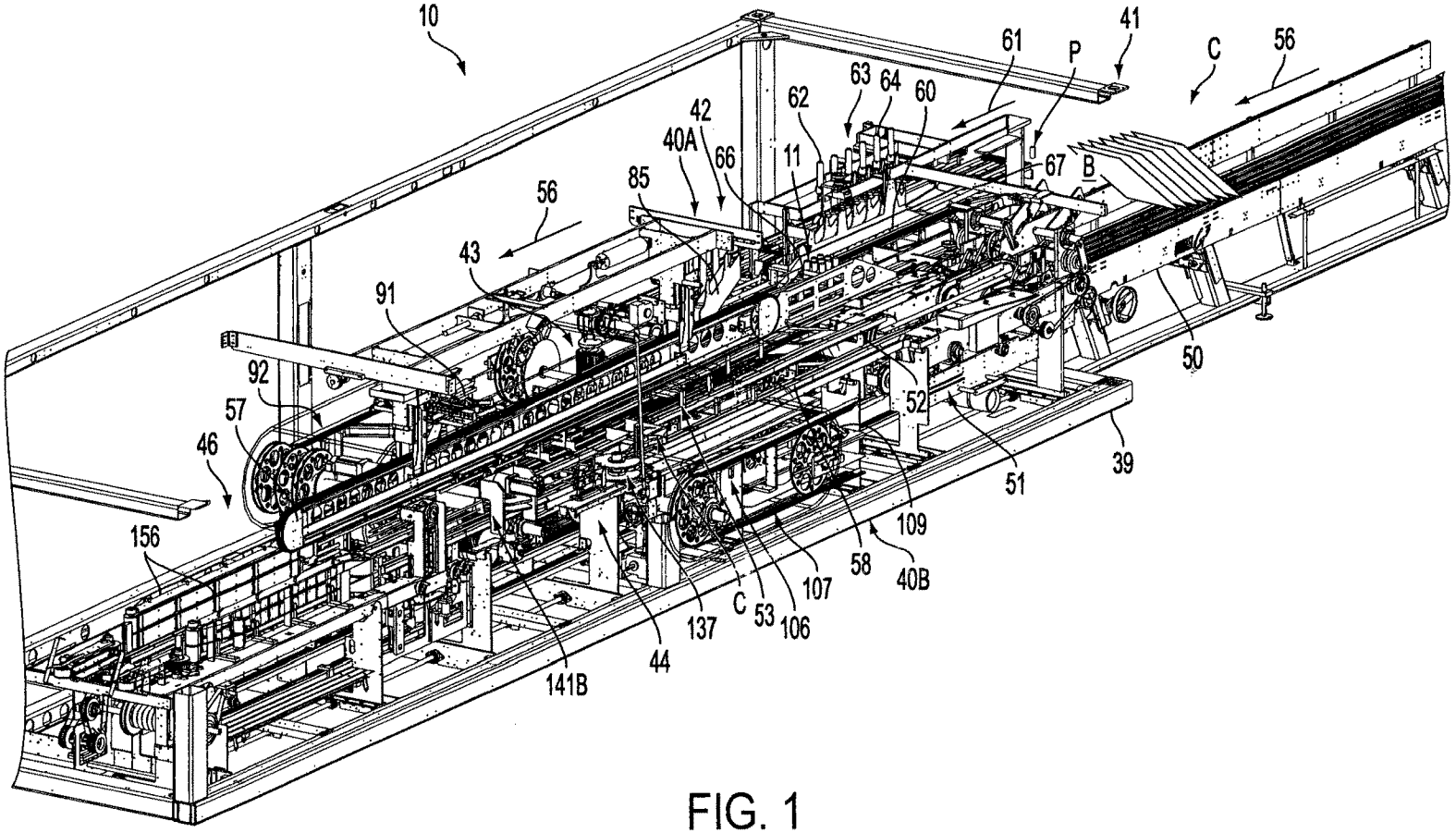
FIG. 1 is a perspective illustration of an embodiment of a packaging system for packaging nested product packs and other, varying product pack configurations according to the principles of the present invention.
Figure 2A:
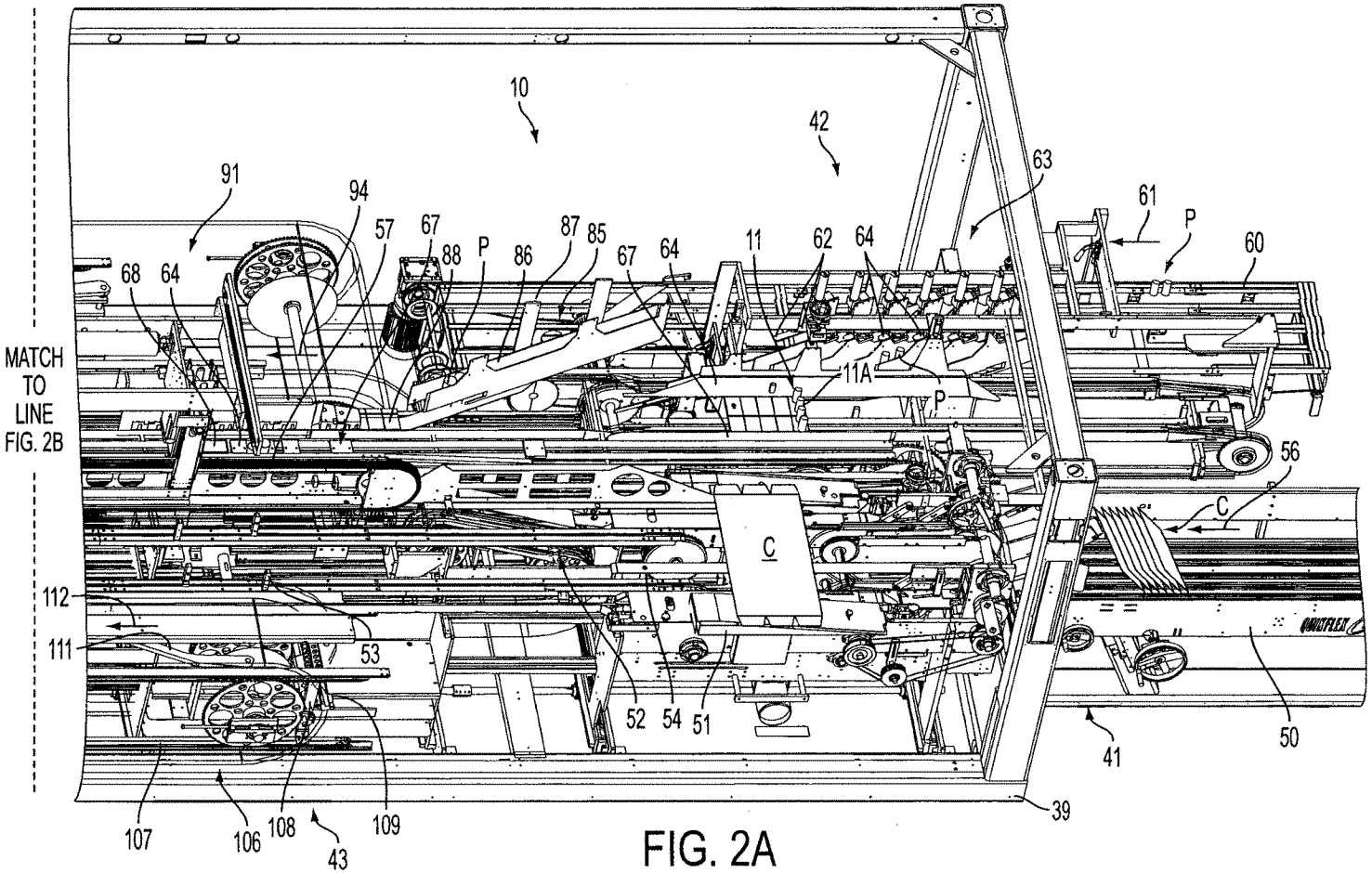
FIGS. 2A-2B are perspective views of the packaging system of FIG. 1.
Figure 2B:
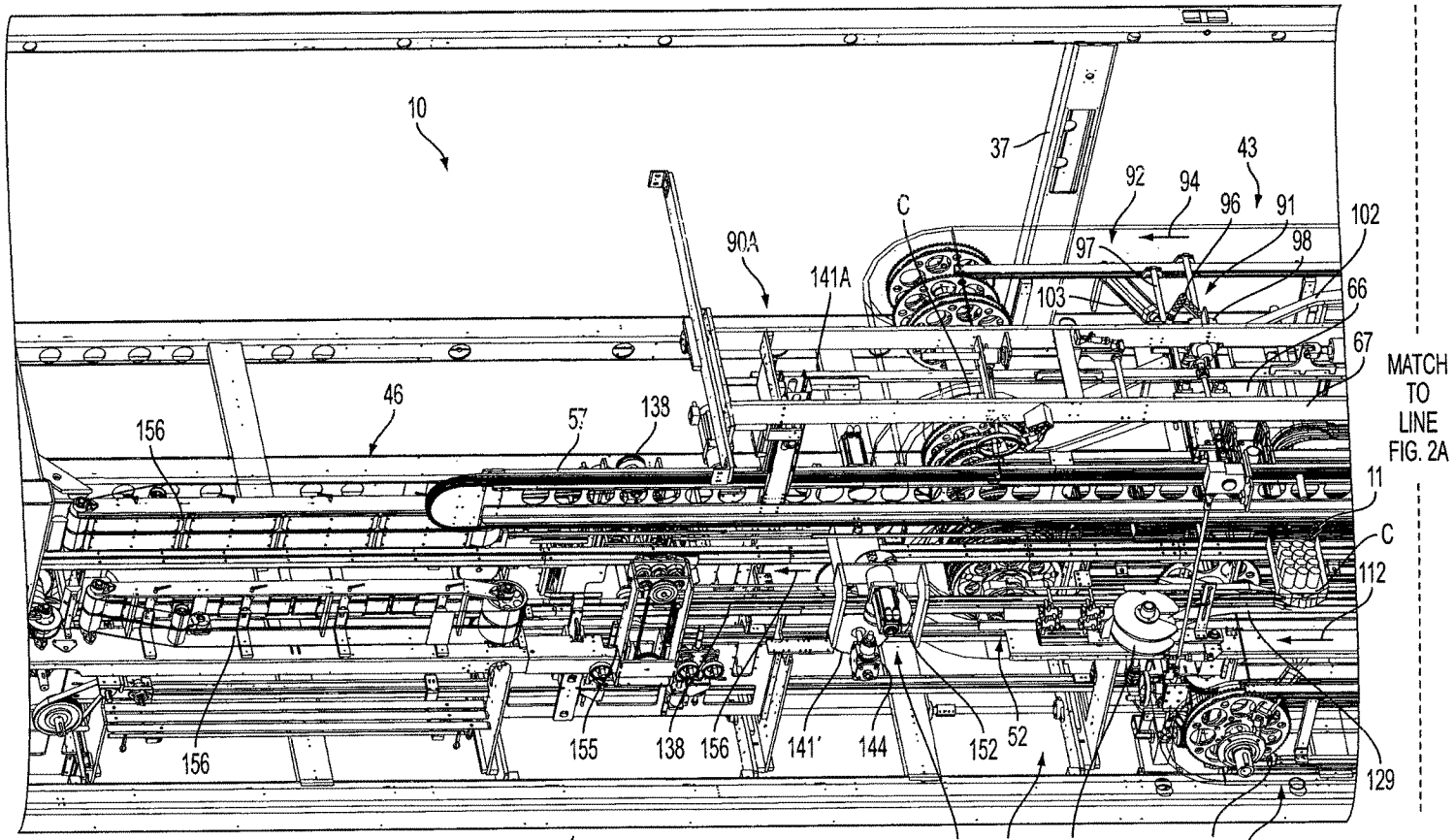
Figure 3A:
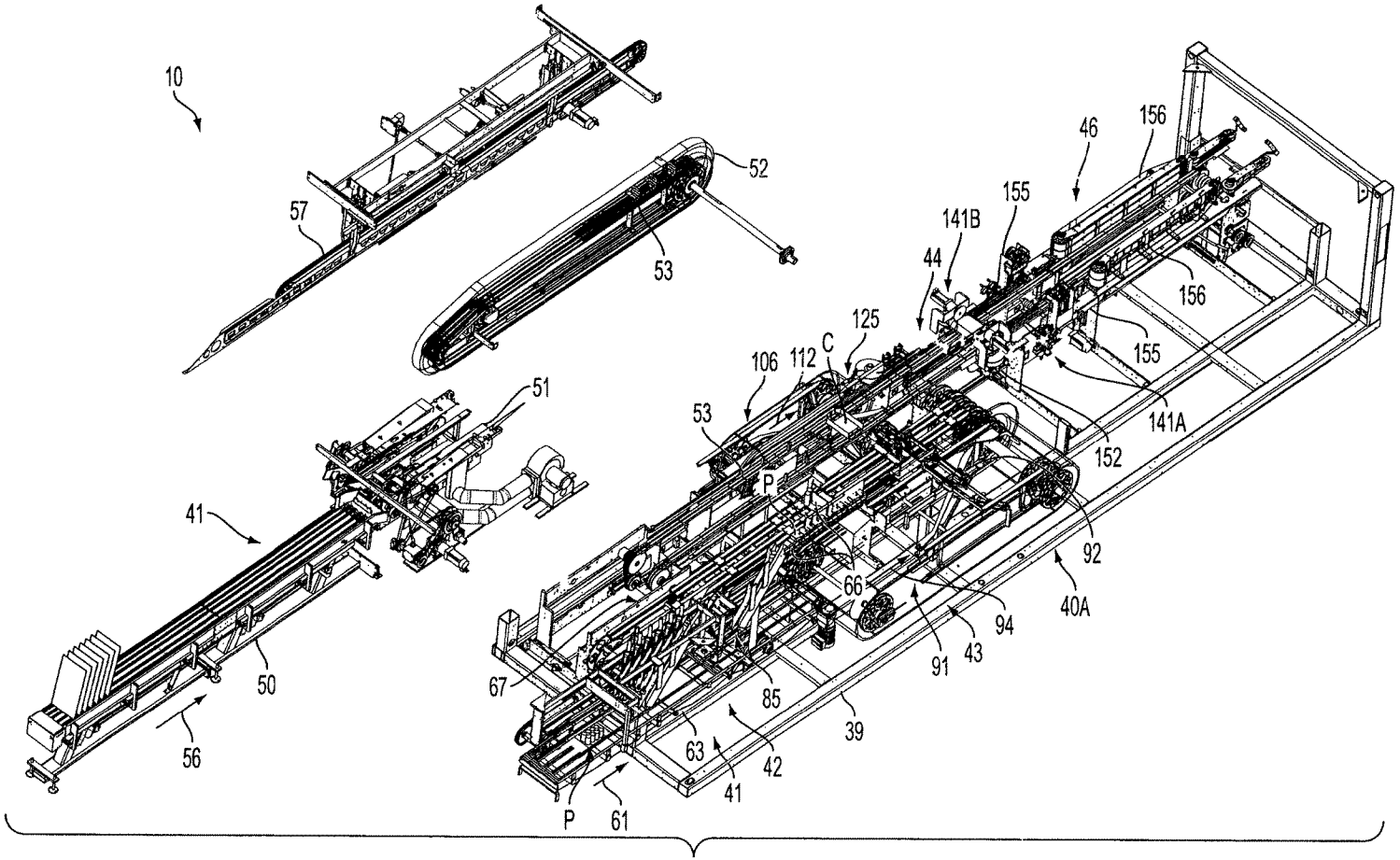
FIGS. 3A-3B are exploded perspective views illustrating the various operative assemblies of the packaging system of FIGS. 1-2B.
Figure 3B:
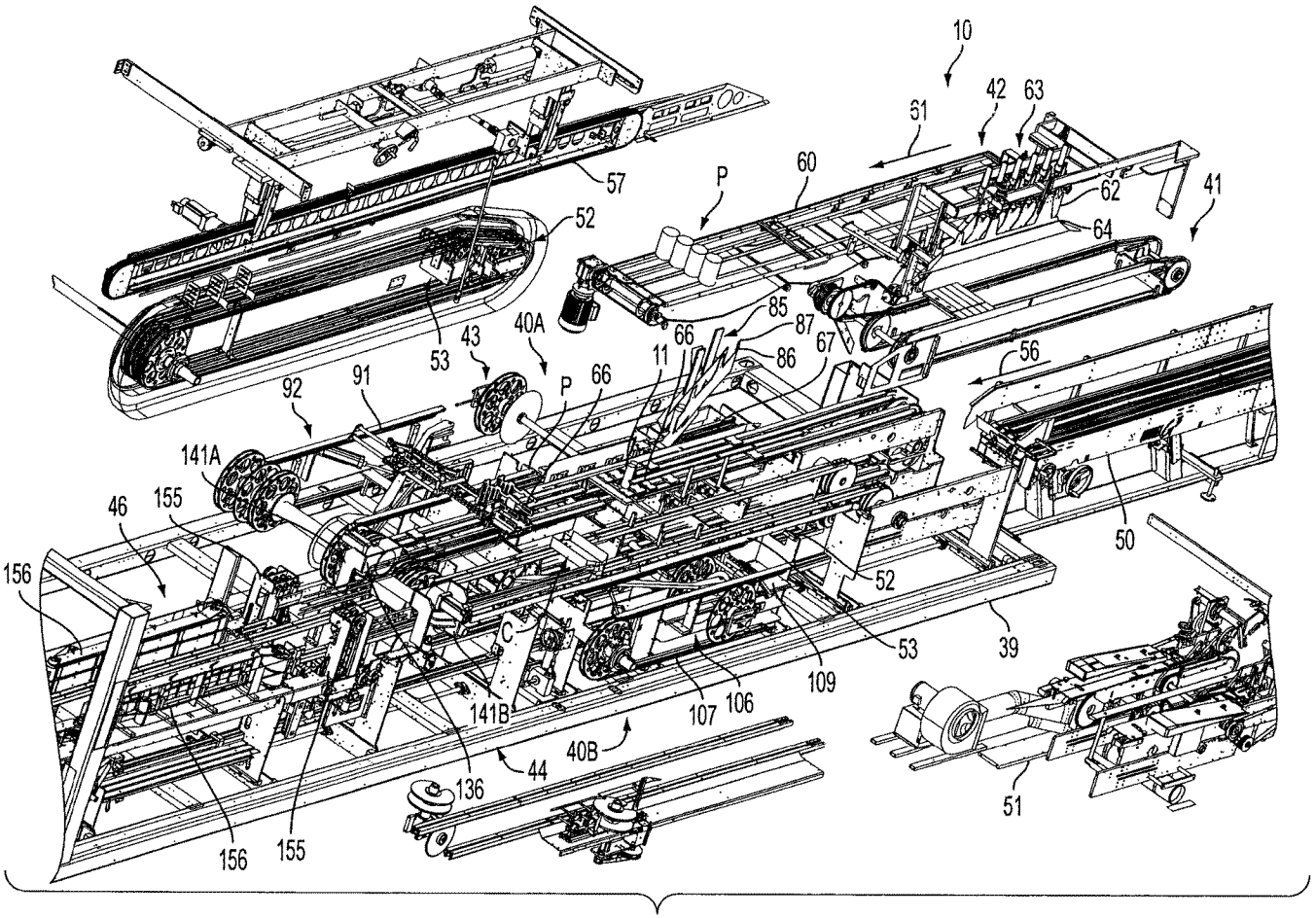

It will be understood that the drawings accompanying the present disclosure, which are included to provide a further understanding of the present disclosure, incorporated in and constitute a part of this specification, illustrate various aspects, features, advantages and benefits of the present disclosure and invention, and together with the following detailed description, serve to explain the principals of the present invention. In addition, those skilled in the art will understand that, according, in practice, various features of the drawings discussed herein are not necessarily drawn to scale, and that dimensions of various features and elements shown or illustrated in the drawings and/or discussed in the following Detailed Description, may be expanded reduced or moved to an exploded position in order to more clearly illustrate the principles and embodiments of the present invention as set forth in the present disclosure.

DETAILED DESCRIPTION OF THE INVENTION

Referring now in greater detail to the drawings in which like numerals indicate like parts throughout the several views, FIGS. 1A-2B schematically illustrate an example embodiment of a packaging system 10 and method of operation according to the principles of the present invention for the selection and grouping of a series of products or articles P, arranged in product packs 11 of varying sizes and/or configurations for loading into cartons C for packaging. While the present invention generally is illustrated for use with packaging of bottles or cans, it will be understood by those skilled in the art that other, varying shapes products or articles also can be packaged by the packaging system and method of operation of the present invention. The present packaging system further is flexible so as to be able to accommodate the selection, grouping and packaging of a wide variety of different size and configuration product packs. For example, the packaging system can be adapted to receive, select, group and package bottles, cans or other products P in various traditional and non-traditional pack sizes or configurations ranging from 4, 6, 8, 9, 10, 12, 15, 16, 20, 21, 22 and 24 groupings or packs to larger pack sizes of 30, 32, 34, 36, 38, 40 or more, arranged in multiple rows of 2, 3, 4, 5, 6, 7 or more products, respectively, i.e., arrangements of 2×3, 2×4, 2×5, 2×6, 3×3, 3×4, 3×5, 3×6, 3×7, 4×4, 4×5, 4×6, 4×7, 4×8, 5×8, etc. . . . products, as indicated in FIGS. 5A-5E. Other varying product pack sizes and configurations also can be used.

In addition, the present invention is particularly adapted to enable the selection, grouping, and packaging of nested or staggered product pack configurations as well as more conventional product pack arrangements. For example, alternative size nested or staggered product pack configurations such as 10 packs, 14 packs (FIG. 5A), 18 packs, 22 packs, 26 packs (FIGS. 5B-5D), 40 packs (FIG. 5E), or other, larger or smaller size nested or staggered packs, can be packaged utilizing the packaging system 10 of the present invention. Such nested or staggered packs can be formed in a substantially rectangular or square arrangement (FIG. 5E) or with a generally convex (FIGS. 5A-5C) or concave (FIG. 5D) configuration. It further will be understood by those skilled in the art of the foregoing pack descriptions are provided simply as examples, and are not to be taken as limiting the packaging system of the present invention solely to packaging such example configurations, but rather a wide variety of different pack sizes and/or configurations including greater or lesser pack sizes and/or configurations can be packaged utilizing the packaging system and method of operation thereof according to the principles of the present invention.

Figure 4:
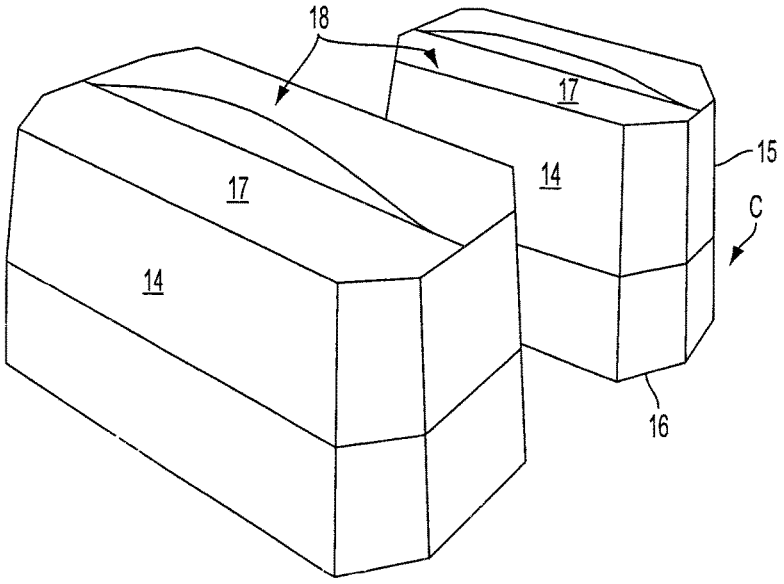
FIG. 4 is a perspective view illustrating example embodiments of cartons that can be used with the packaging system according to the principles of the present invention.
Figure 5A:
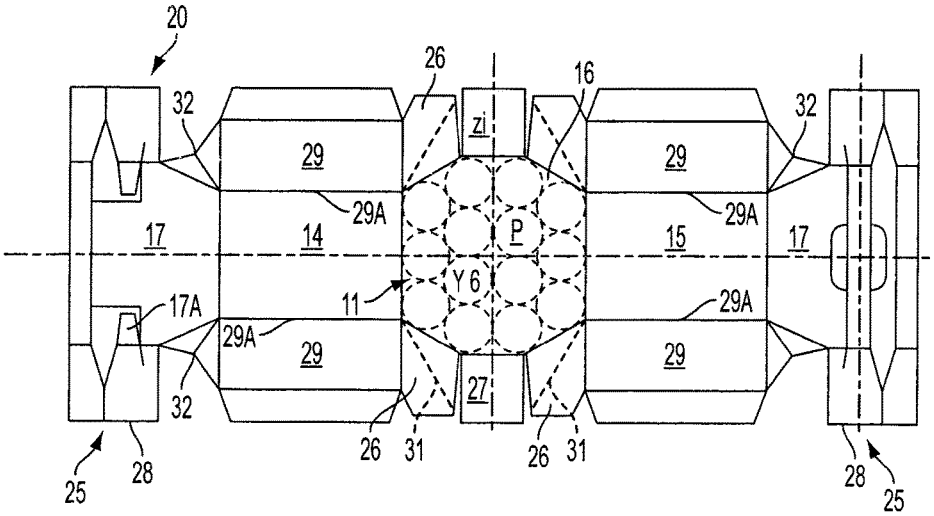
FIGS. 5A-5E illustrate various example embodiments of carton blanks, and/or nested product pack configurations adapted to be received therein, which can be packaged by the packaging system of the present invention.
Figure 5B:
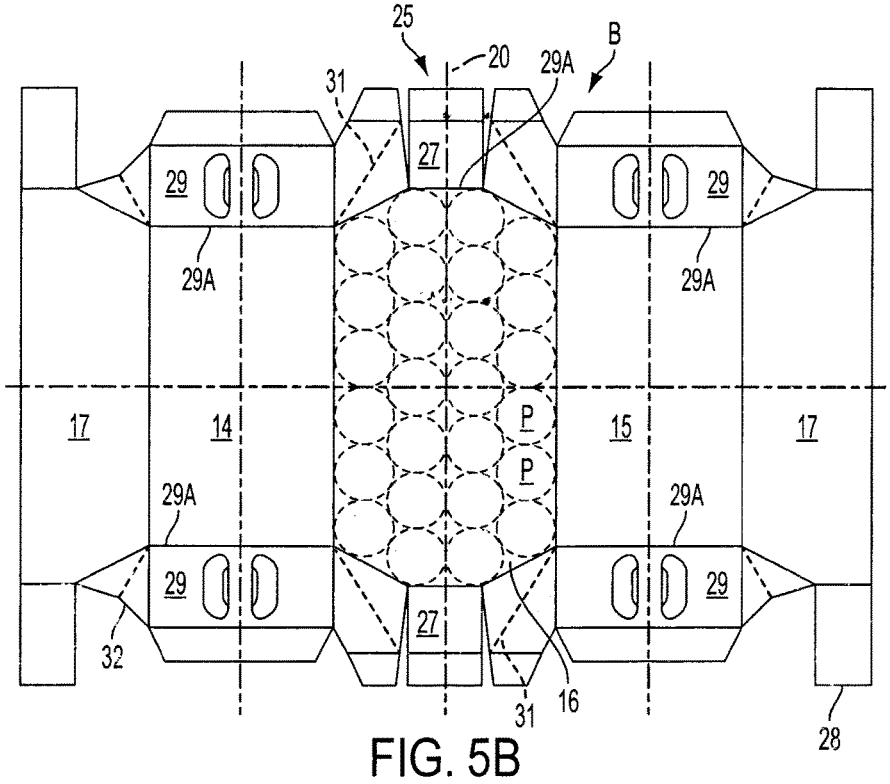
Figure 5C:
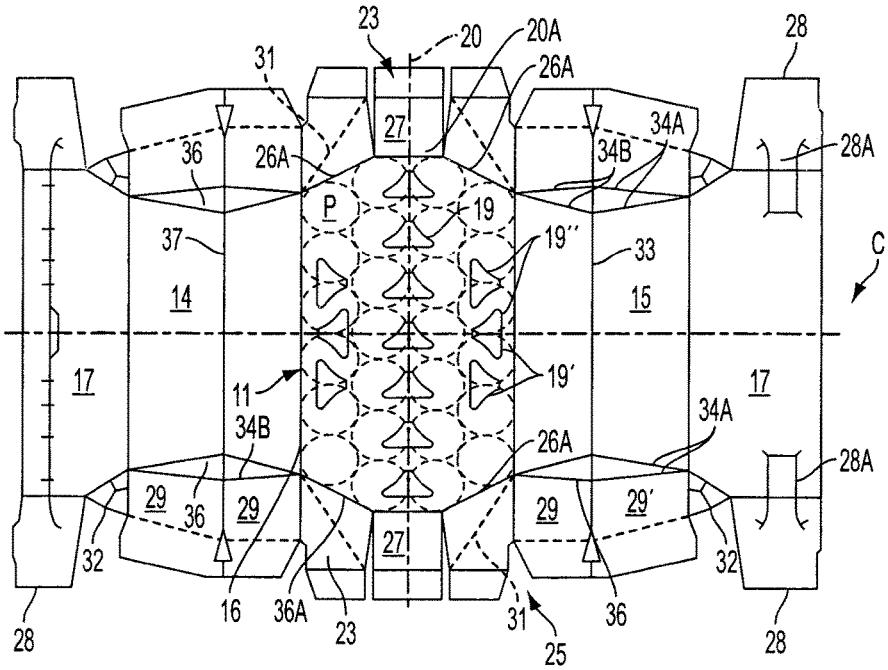
Figure 5E:
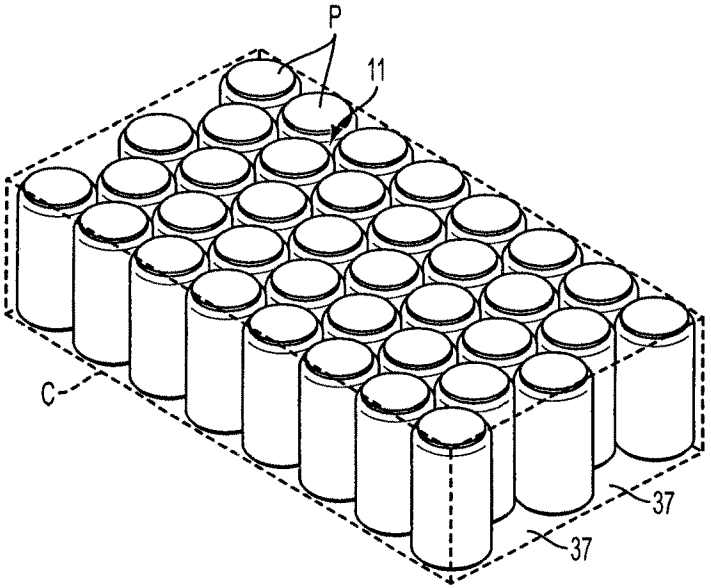
Figure 5D:
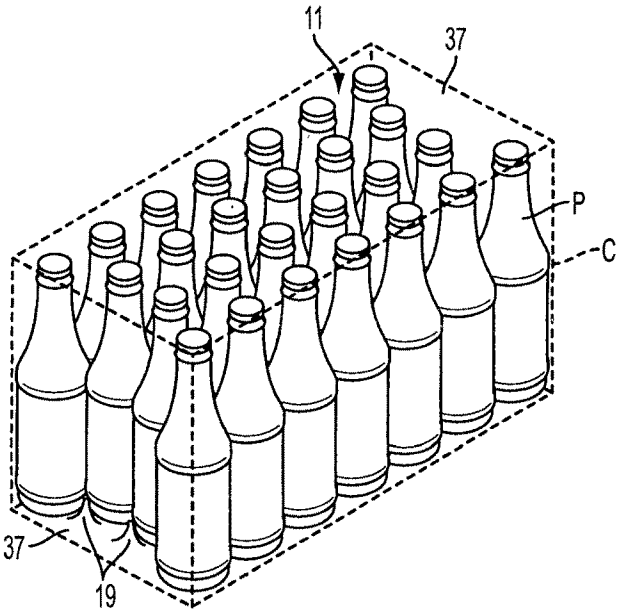

FIGS. 4 and 5A-5C illustrate example cartons C and carton blanks B for forming such cartons, for the packaging of various size and/or configurations of nested product packs 11 (FIGS. 5A-5E) of varying sizes and/or configurations using the packaging system and method of operation thereof according to the principles of the present invention. Each of the carton blanks B shown in FIGS. 5A-5C generally will include side panels 14 and 15, a base panel 16, and further can include top panels 17A/17B that can be folded over and glued together to define the top or upper surface 18 of each carton C, as indicated in FIG. 4. Alternatively, the cartons can be formed with substantially solid or unitary top panels or in other configurations as needed or desired. As also shown in FIGS. 5C-5D, the cartons further can include a series of article protection features 19 such as fins, tabs, or other projections formed into the base or bottom panel 16. For example, as shown in FIG. 5C, a first series of protection features 19' can be arranged in a first orientation and location adjacent the side panels 14/15, while a second series of article protection features 19" can be formed in a second orientation arranged along a longitudinal axis or center-line 20 of the cartons, which second series of article protection features can be activated after loading of the product pack 11 therein to provide a desired separation and protection to the bottles or other fragile articles of the product pack within the carton.

Each of the cartons C (FIGS. 2A-3B and 4) further generally will include first and second or loading and stabilizing side ends 21 and 22, respectively, defining openings 23 (FIGS. 2B and 7A-7B) through which the product packs can be received following folding or erection of the cartons into an open ended carton sleeve. The open ends 23 of the first and second sides of the cartons 21 and 22 generally will be defined by a series of end flaps 25 (FIGS. 5A-5C), generally including top, bottom and side flaps. In one embodiment, the cartons can be provided with a configuration substantially matching the configuration of the product pack received therein. For example, FIGS. 5A-5C illustrate product packs with an extended or generally convex profile or configuration, about which their cartons can be formed. In such an embodiment, the end flaps of the cartons can include lower end flaps 26 formed at each end of the base panel 16 of each carton, and separated from the base panel by fold lines 26A; bottom flaps 27 separated from the base panel 16 by fold lines 27A, top or upper end flaps 28 separated from their respective top panels 17A/17B by fold lines 28A, side flaps 29 (FIGS. 5A-5B) and 29' (FIG. 5C) generally separated from the side panels 14/15 along fold lines 29A. Lower gussets 31 also can be formed along/between the lower end flaps 26, as indicated at dashed lines 31 in FIGS. 5A-5C, while additional, upper gussets 32 further can be formed between the upper side and/or upper end flaps 29 and the top panels 17A/17B.

It additionally will be understood from FIGS. 5A-5C that other, varying arrangements of end flaps, side, top and base panels, and gussets also can be provided as needed to accommodate variations in the sizes and/or configurations of product packs, including nested product packs as shown, as well as to accommodate the packaging of different types of products forming such product packs. For example, as indicated in FIG. 5C, where bottles are used as the products P of the product pack 11, the side panels and side flaps 29/29' of the cartons can be provided with additional fold lines extending across their width, indicated at lines 33, as well as additional fold lines 34A-B between the upper side panels and side or upper end flaps, defining an angled or substantially diamond shaped shoulder configuration shown at 36 in FIG. 5C, adapted to help conform the side panels to the neck shape of the bottles of the product pack as needed or desired. As also shown in FIG. 5C, the side or upper end flaps 29 also can be split or separated substantially along fold line 33 as indicated at 29A/29B to further facilitate the configuring/folding of the upper end flaps about the bottles at the ends of the nested product pack 11 to help ensure a tight, close fit package.

Still further, the cartons can be formed with substantially square or rectangular configurations, without the need for gussets, additional side and/or end flaps, or other features adapted to more closely approximate the configuration of a product pack received therein, which can result in reduction in the amount of paperboard or other materials used to form the cartons. For example, as shown in FIGS. 5D-5E, for nested product packs 11 having a recessed or concave configuration or a generally rectangular or similar arrangement with staggered or offset rows, substantially rectangular or square shaped cartons can be used. The open spaces or recessed areas between the ends of the rows of products, such as indicated at 37 in FIGS. 5D-5E, can provide additional space at the ends of the cartons for handles or hand grips to be formed in the cartons, and/or to provide space for inserts or other features if needed or desired.

As shown in FIGS. 1A-3B, the packaging system 10 can generally be constructed in similar fashion to and/or incorporate the features of a packaging machine, such as a QUICKFLEX® 2100 style packaging machine as manufactured by Graphic Packaging International, Inc. The packaging system 10 thus can be adapted to operate in a conventional manner or fashion for packaging traditional style/configuration product packages, while further providing the additional flexibility and capability of accommodating a wider variety of package sizes and/or configurations, including the packaging of nested product pack configurations or other non-traditional pack sizes or configurations without requiring additional equipment or substantial reconstruction thereof.

As indicated in the figures, the packaging system 10 generally will include a frame 39, defining a first, loading side 40A and a second, stabilizing side 40B of the packaging system, and which can include a housing or guards (not shown) and which frame supports the various operative systems and assemblies of the packaging system 10. The packaging system further generally will include an infeed area 41 at which the cartons C and products P (FIG. 1), respectively, are introduced into the packaging system, a downstream selection and grouping area or zone 42 in which the products are selected and formed into product packs, after which they are passed into a loading zone or area 43 for loading for loading into their associated or corresponding cartons, a folding/sealing area or zone 44, and a compression area 46 at the downstream end of the packaging system to complete the packaging of the product packs within their associated cartons.

The infeed area or section 41 of the packaging system 10 generally will include an infeed conveyor 50 for conveying a series of cartons C, typically arranged in a stacked series as they are conveyed along the infeed conveyor 50, as indicated in FIG. 1. The cartons are fed in stacked series along the infeed conveyor 50 to a carton loader 51, which feeds individual cartons C onto a carton conveyor 52 (FIGS.

Figure 6A:
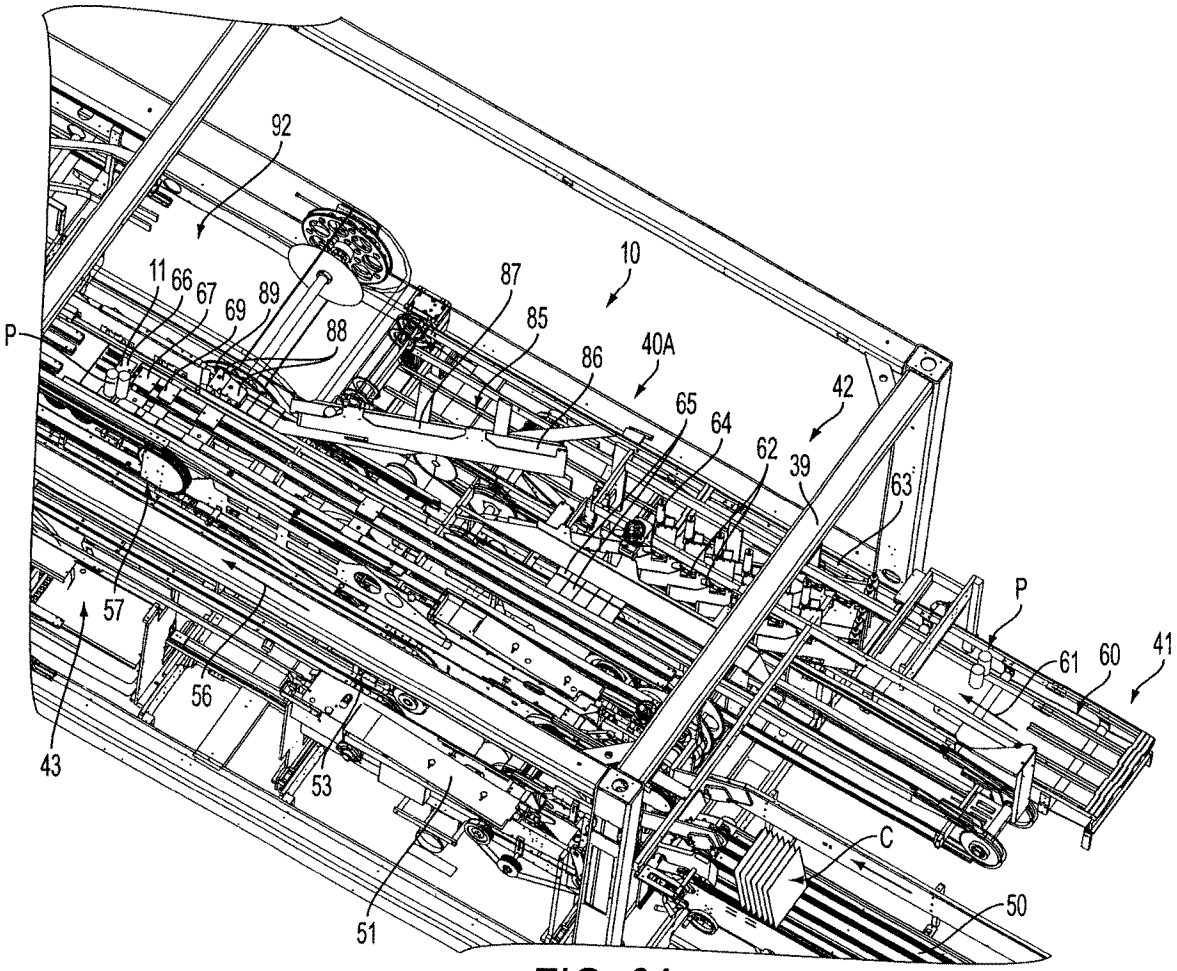
FIGS. 6A-6B are perspective illustrations of new product selection and grouping areas of the product packaging system of FIGS. 1-3B.
Figure 6B:
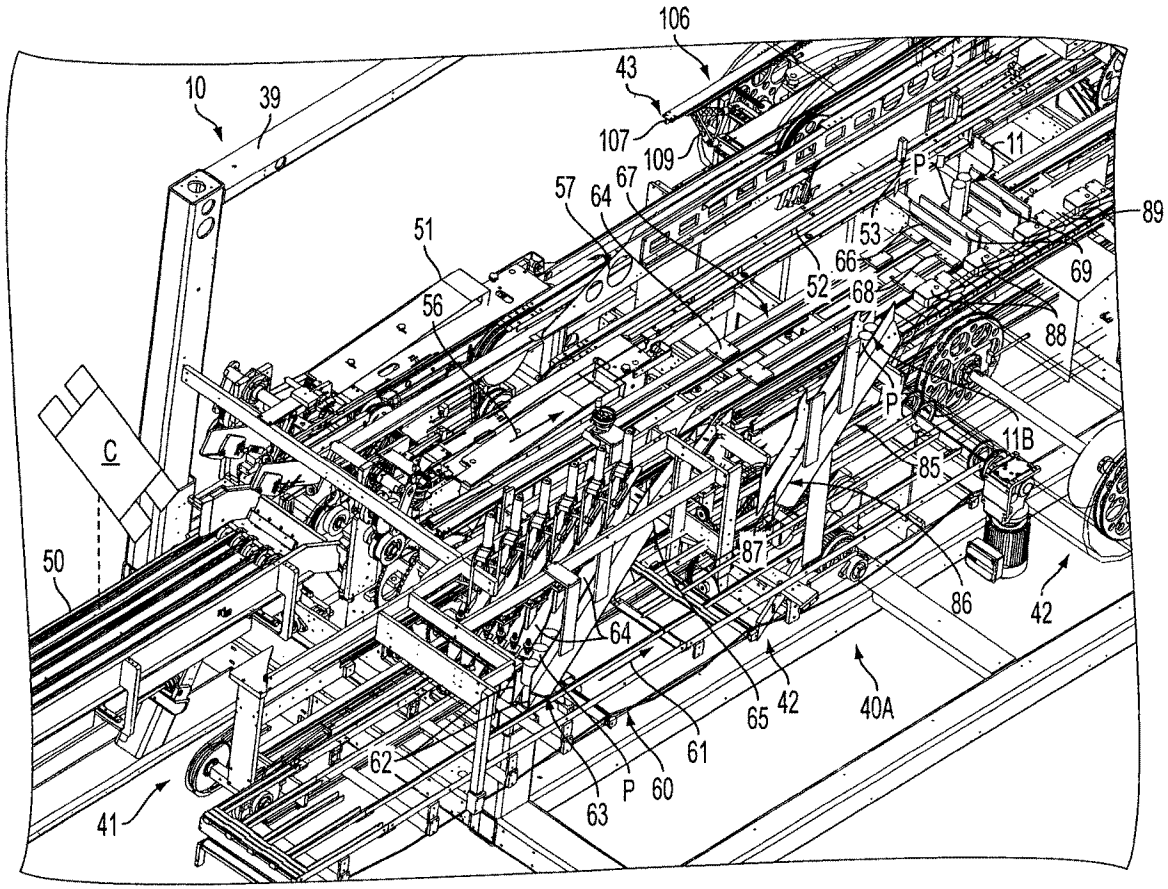
Figure 7A:
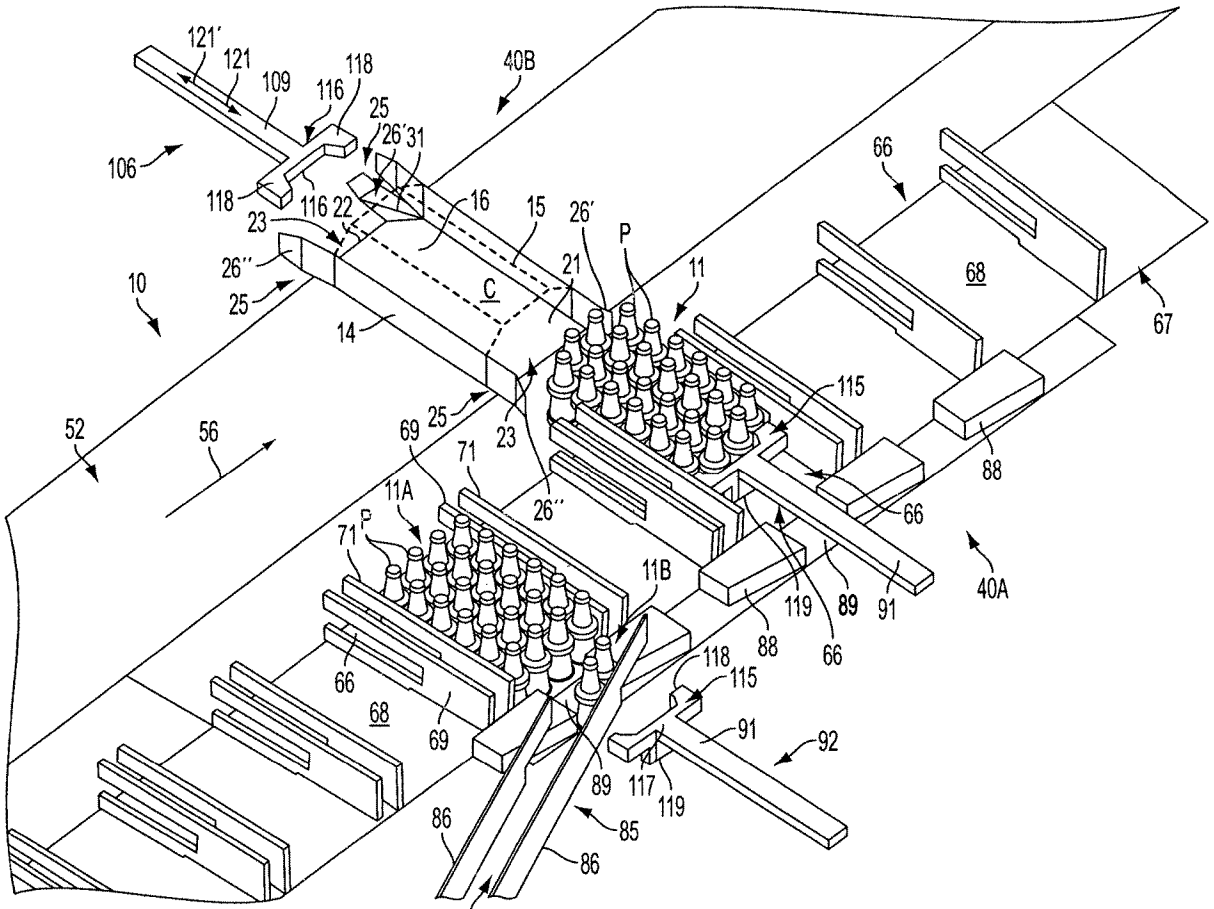
FIG. 7A is a perspective illustration schematically illustrating the formation of a nested product group for feeding into a carton according to one example embodiment of the present invention.
Figure 7B:
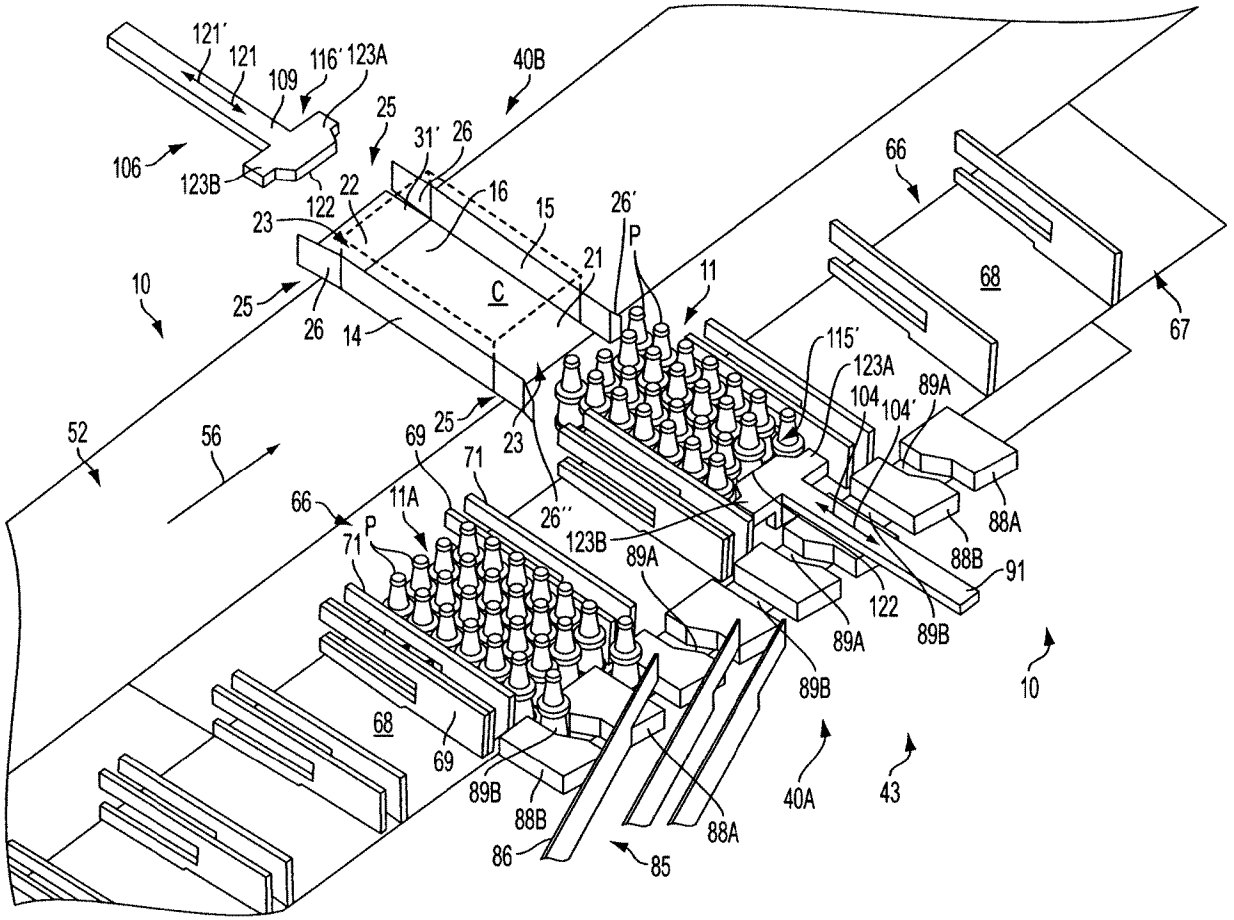
FIG. 7B is a plan view illustrating the formation an alternative nested product group for feeding into a carton using the packaging system according to the principles of the present invention.

2A, 3A-3B, 6A-6B). An example of such a carton loader and carton infeed conveyor 50 generally is shown in U.S. Pat. No. 8,246,290, the disclosure of which is incorporated herein by reference as if set forth in its entirety. The carton conveyor 52 generally will include a lugged or flighted conveyor having a series of pusher lugs 53 (FIGS. 2B, 3B and 6B) carried by belts or chains 54 in between which each of the cartons will be received from the carton loader 51 and conveyed along a path of travel as indicated by arrow 56. As additionally indicated in FIGS. 2A-3B, an overhead flight or lug conveyor system/assembly 57 for erecting the cartons C, such as for example, shown in U.S. Pat. No. 5,809,746, the disclosure of which is incorporated by reference as if fully set forth herein, will be provided along the path of travel 56 of the cartons for engaging and erecting the cartons into an open ended sleeve configuration for loading of products therein, such as indicated in FIGS. 7A-7B.

As further shown in FIGS. 2A, 3A-3B and 6A, the infeed section or area 41 of the packaging system 10 further includes a product infeed conveyor 60, which will feed a series of products, such as bottles or cans, along an initial path of travel, indicated by arrow 61 into the packaging system 10. The product infeed conveyor 60 generally will include a substantially flat belt having an expanded width of a size to accommodate a desired number of products thereacross. The product infeed conveyor will feed the products to the selection and grouping station or area 42 where the products can be selected/separated into discrete by a series of guides 62, of a primary selector 63. The guides 62 can be moved into desired positions across the width of the product infeed conveyor as needed to accommodate or separate the products into a desired number of lanes 64 of product lines. For example, in FIGS. 2A and 6B, six guides 62 are shown in use in the primary selector 63, although it will be understood that greater or fewer number of guides 62, defining greater or fewer product lanes 64, also can be provided. The product lanes 64 of the primary selector 63 will separate the incoming products into discrete lines of products, which will be engaged by a series of selector wedges 65 that select and/or capture a desired number of products therebetween for guiding an initial or first series of products into the flights 66 of a product selector conveyor 67 moving along a path of travel substantially parallel to the path of travel 56 of the cartons moving along the carton conveyor.

Figure 8A:
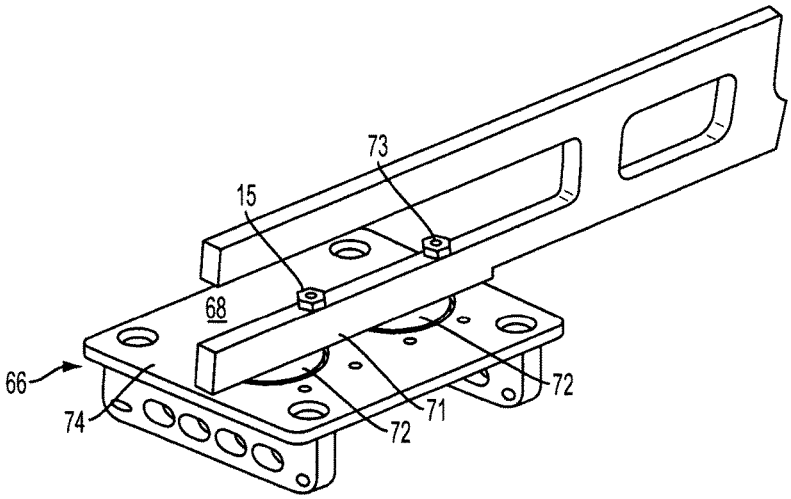
FIGS. 8A-8B are perspective illustrations of top and bottom sides of one embodiment of the pack reducing flight of the selector conveyor of the present invention according to one example embodiment.
Figure 8B:
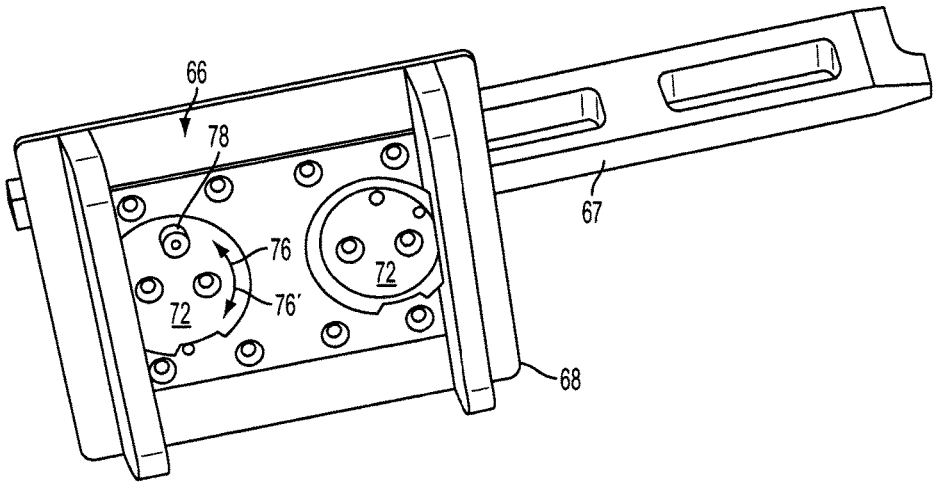
Figure 9A:
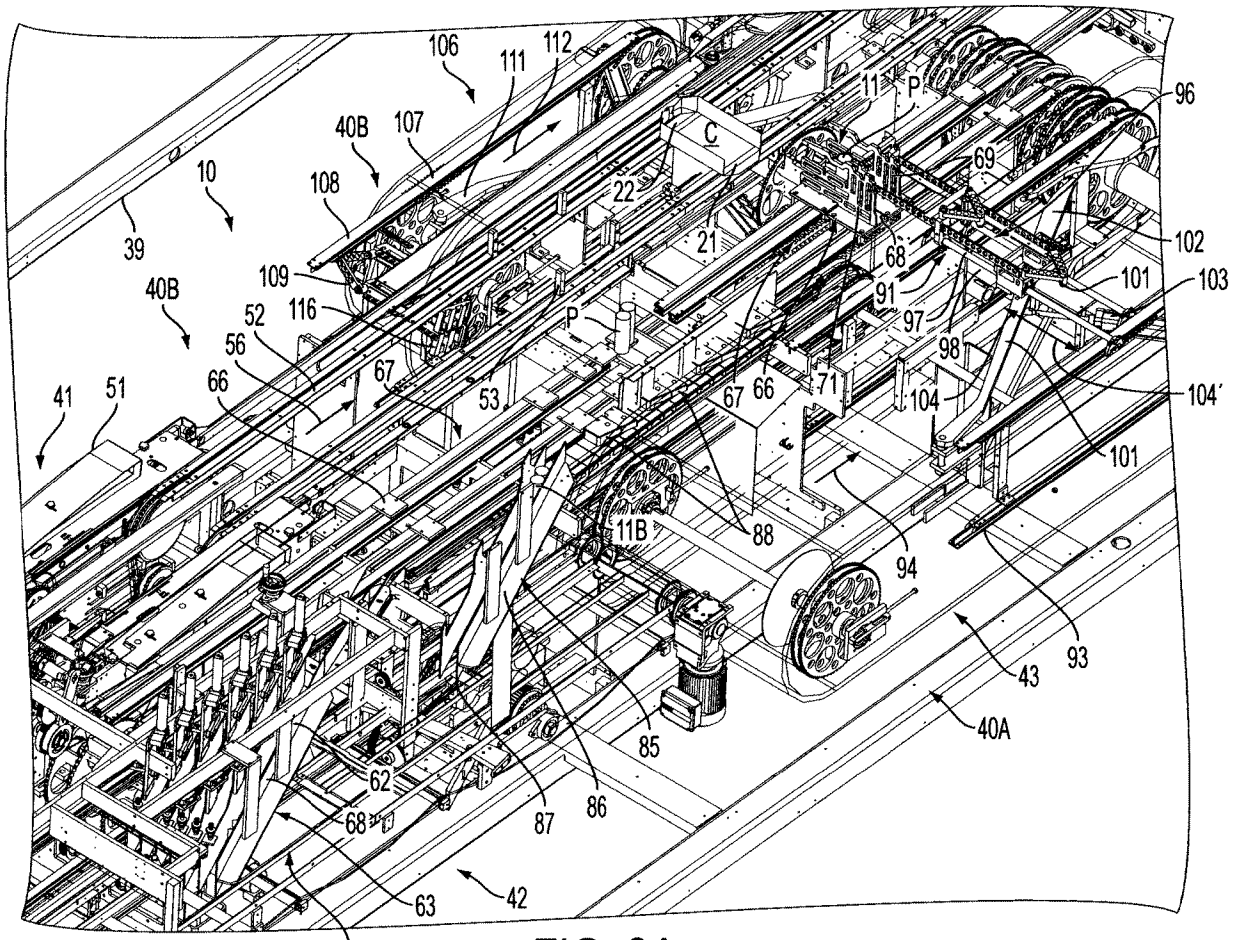
FIGS. 9A-9C are perspective illustrations of the loading and folding/sealing area of the packaging system of FIGS. 1-3B.
Figure 9B:
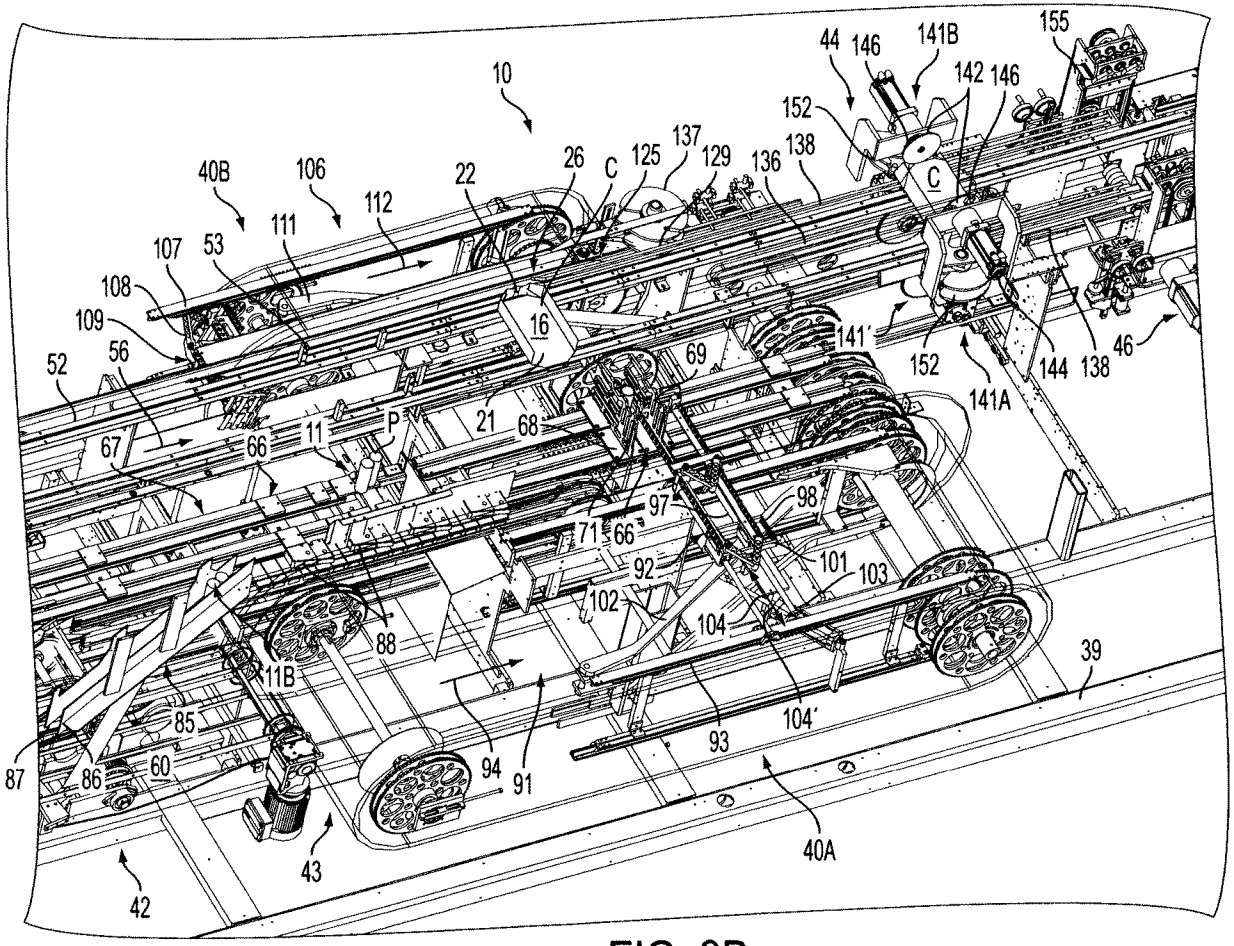
Figure 9C:
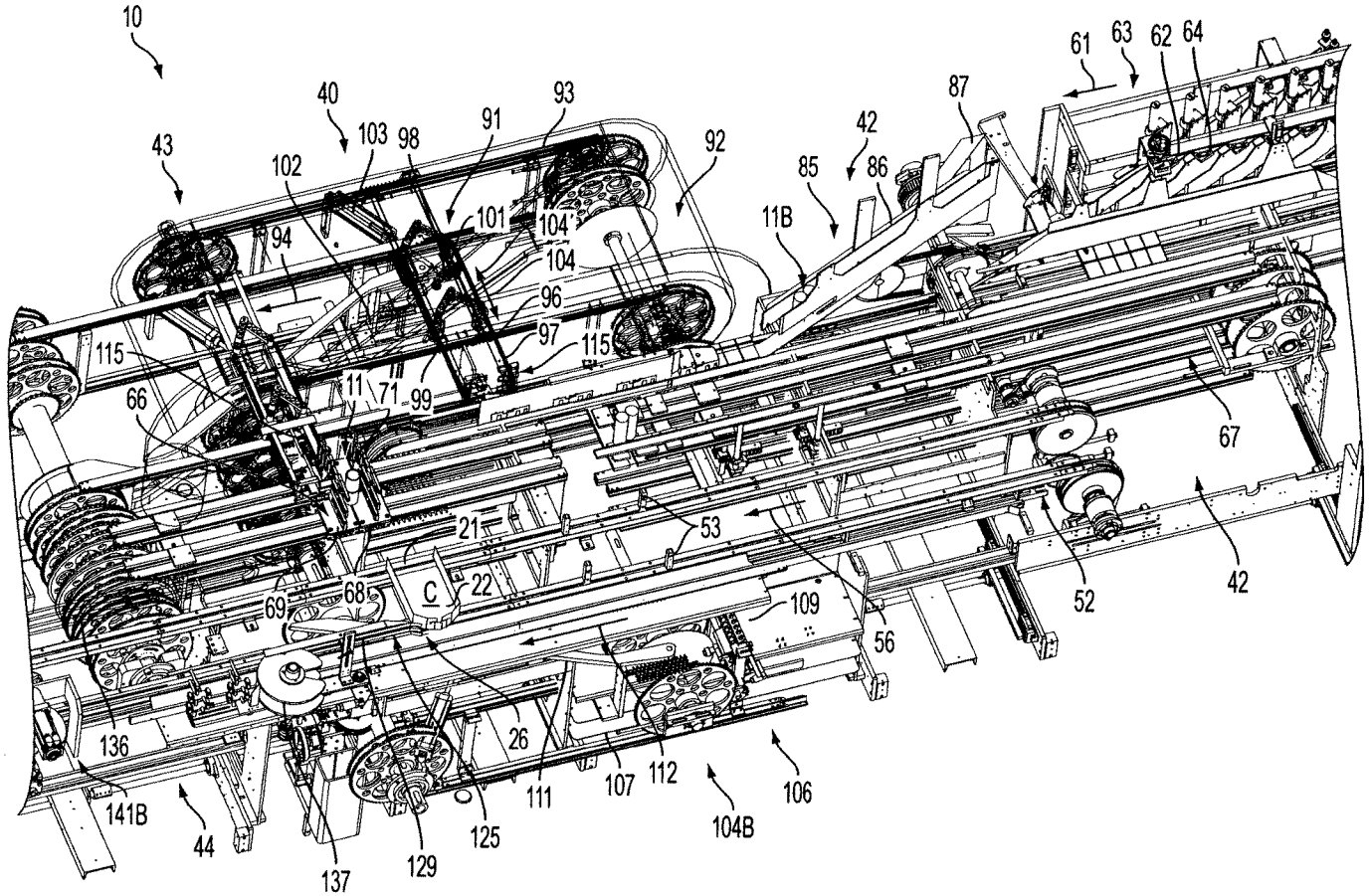
Figure 10:
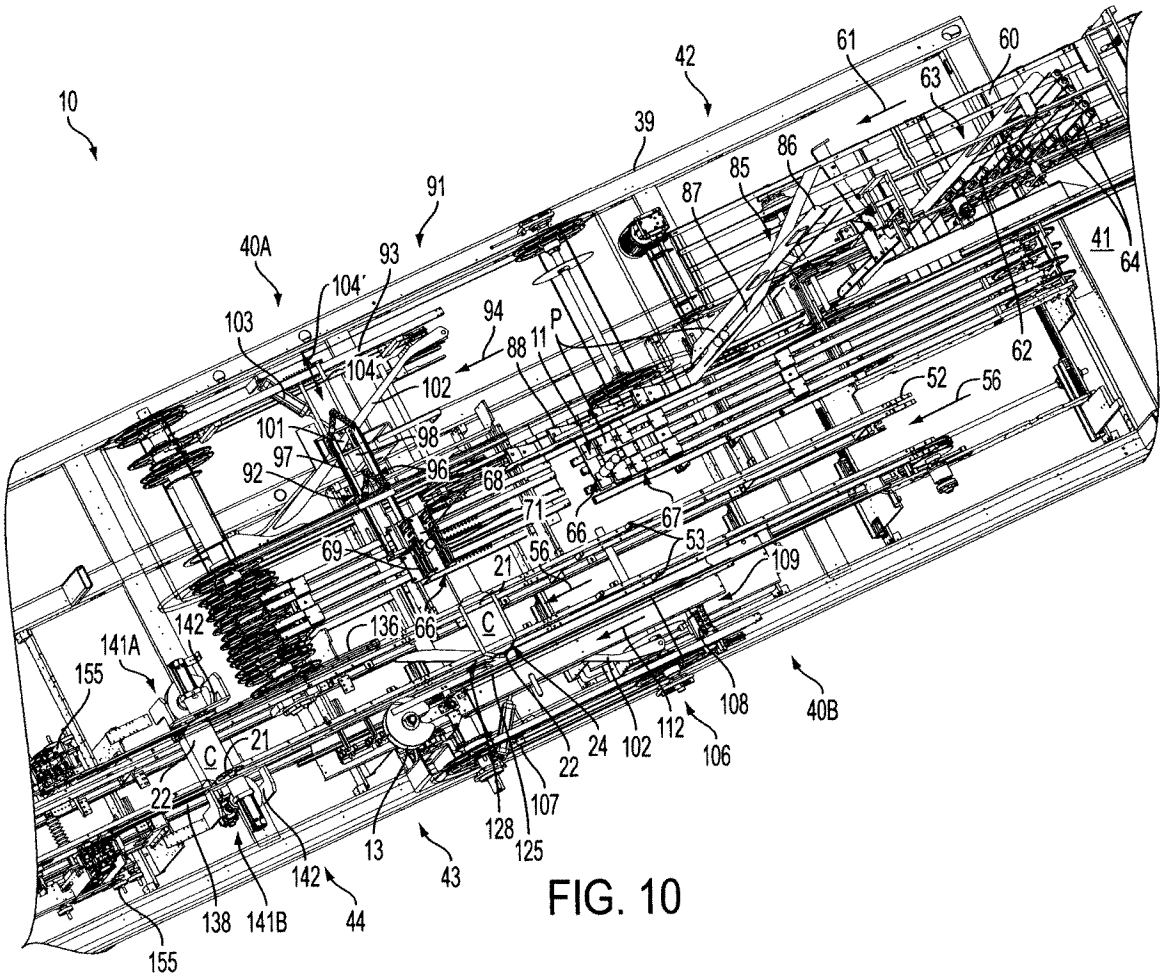
FIG. 10 is a plan view illustrating the product selection and grouping, and loading areas of the packaging system of FIGS. 1-3B.

As indicated in FIGS. 6A-7B, a desired number of products from each of the product lanes are engaged and urged by the selector wedges 65 into associated flights 66 of the selector conveyor 67 in order to form an initial product pack or grouping 11A moving substantially parallel to the cartons for loading therein. As further illustrated in FIGS. 7A-8A, each of the flights 66 of the flighted product selection conveyor 67 generally can be constructed as a pack reducing flight which, in one embodiment, can include a substantially flat base plate 68 on which the packs are loaded an upstream wall 69, which can be fixed in place, and a moveable downstream wall 71. The downstream wall 71 can be mounted on rotary members 72 (FIGS. 8A-8B), such by bearings or pivot pins 73 (FIG. 8B), and thus can be moveable across the upper surface 74 of its associated base plate 68, as indicated by arrows 76 and 76', upon rotation of the rotary members 72, as indicated by arrows 77 and 77' in FIG. 8B. A cam roller 78 or similar guide pin can be mounted to a lower surface of at least one of the rotary members 72, and can engage a cam track or guide 79 (FIGS. 6A-6B) extending along the selector conveyor so as to cause the rotation of the rotary members as the cam roller follows along its associated cam track or guide.

As a result, the wall 71 of each flight generally will be urged toward and away from the product pack being formed within its associated flight as the selector conveyor is moved along its path of travel, thus applying a compressive force against the product pack. This compressive force generally results in tightening or collapsing of the spacing between the products within the product pack being formed as the product pack is engaged between the upstream and downstream walls of the flight, and further can assist in helping to guide and stabilize the upstream and downstream rows of the products of the product pack as it is loaded into a carton, as indicated in FIG. 7A. The shape and/or position of the cam track 79 further can be varied and/or changed as needed to control the collapse and/or the amount of compression provided to the product pack. Where such compression is not needed, such as for running more conventional or standard product packs and cartons, the cam track can be moved out of engagement with the cam rollers and/or removed, or can be otherwise reconfigured as needed.

Figure 11A:
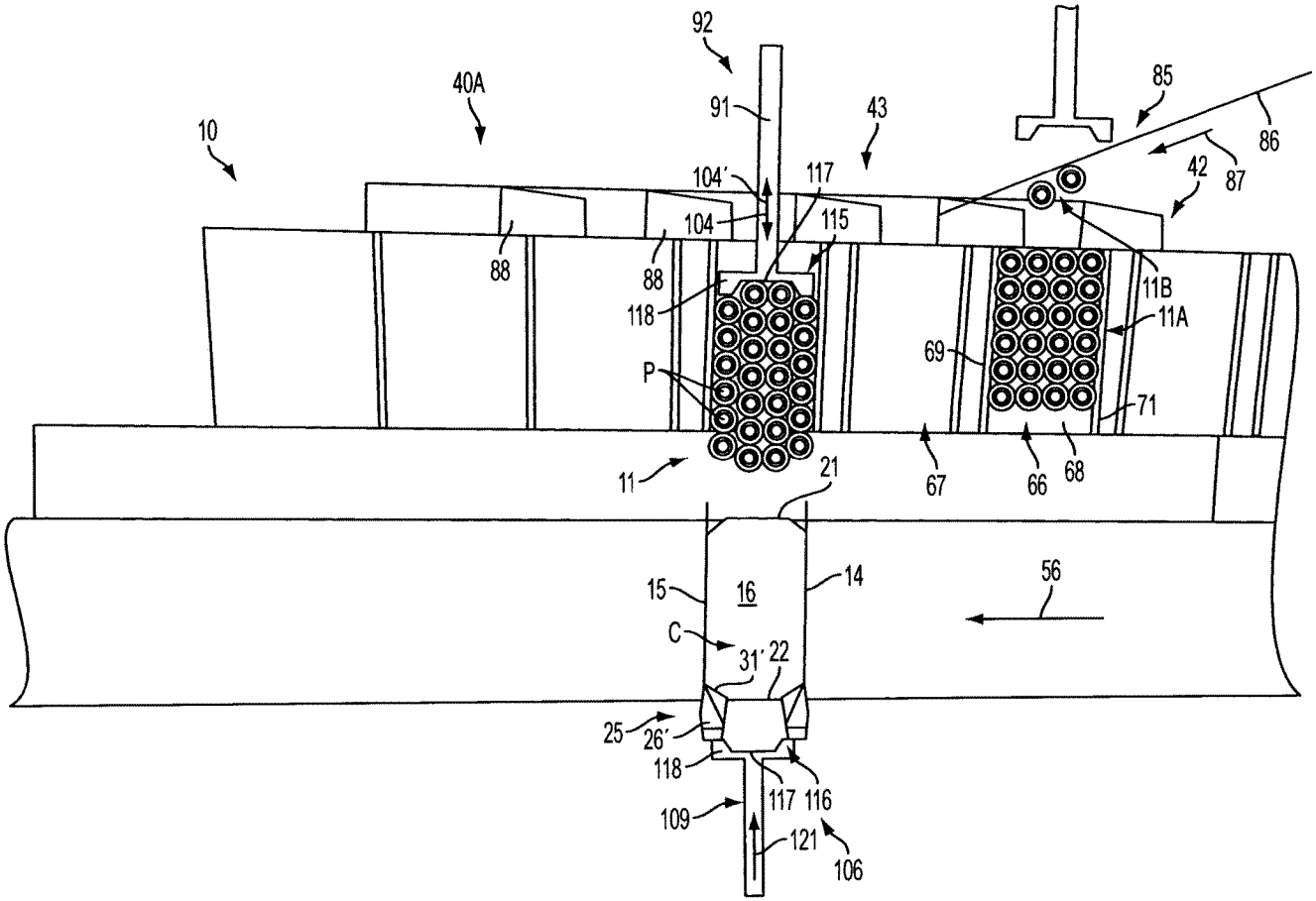
FIGS. 11A-11G are schematic views illustrating the selection and grouping of various example configuration nested product packs and their subsequent loading into a carton.
Figure 11B:
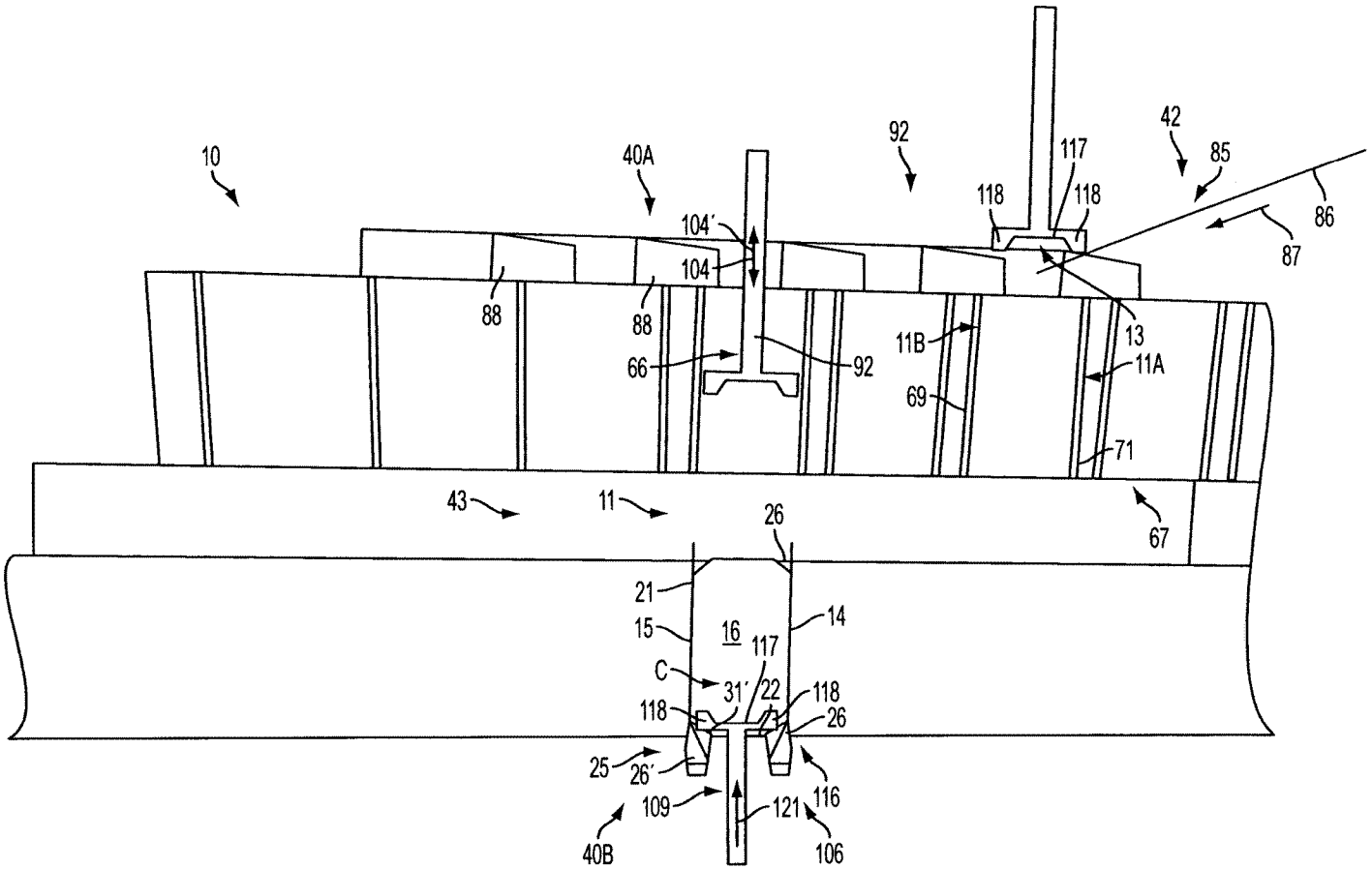
Figure 11C:
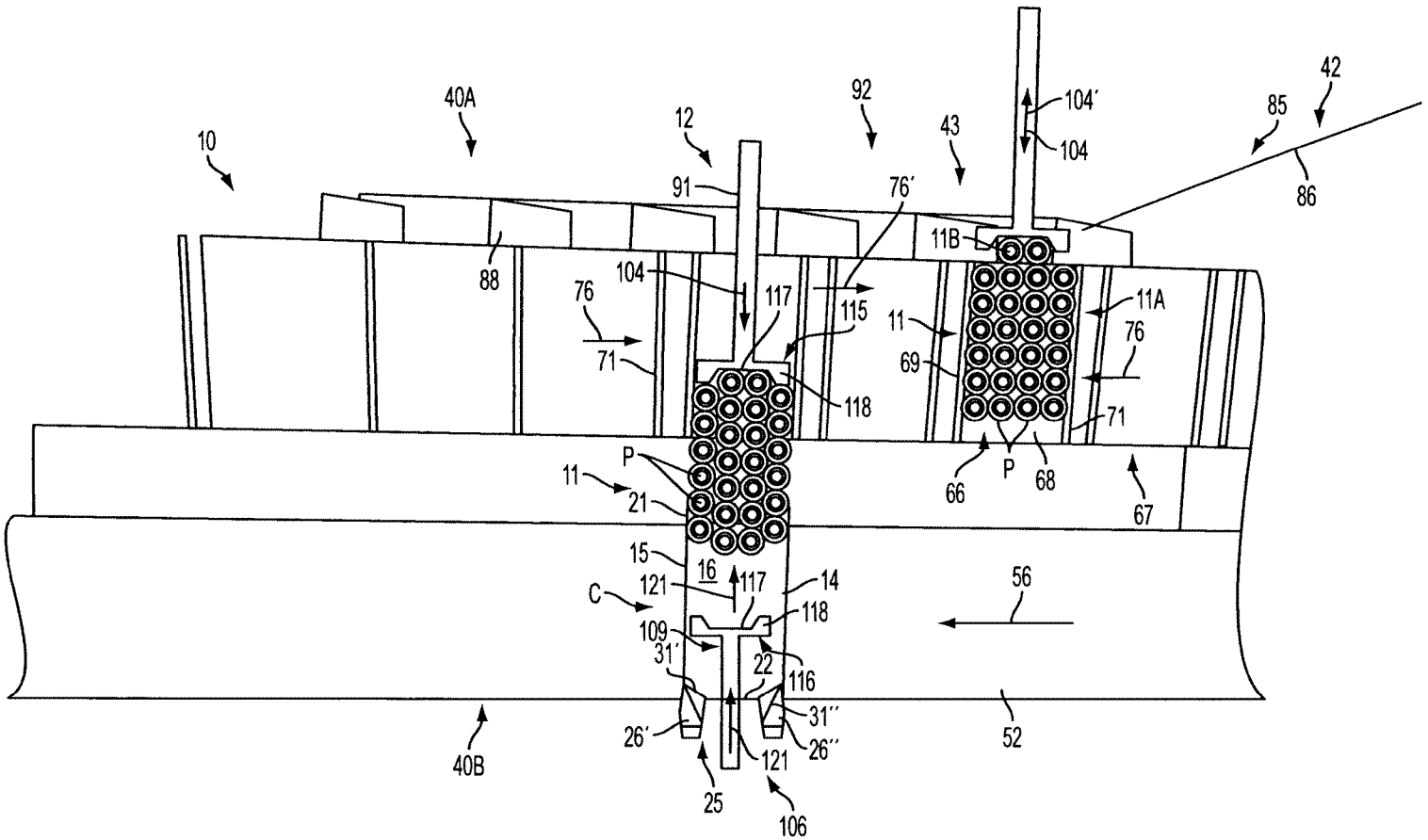
Figure 11D:
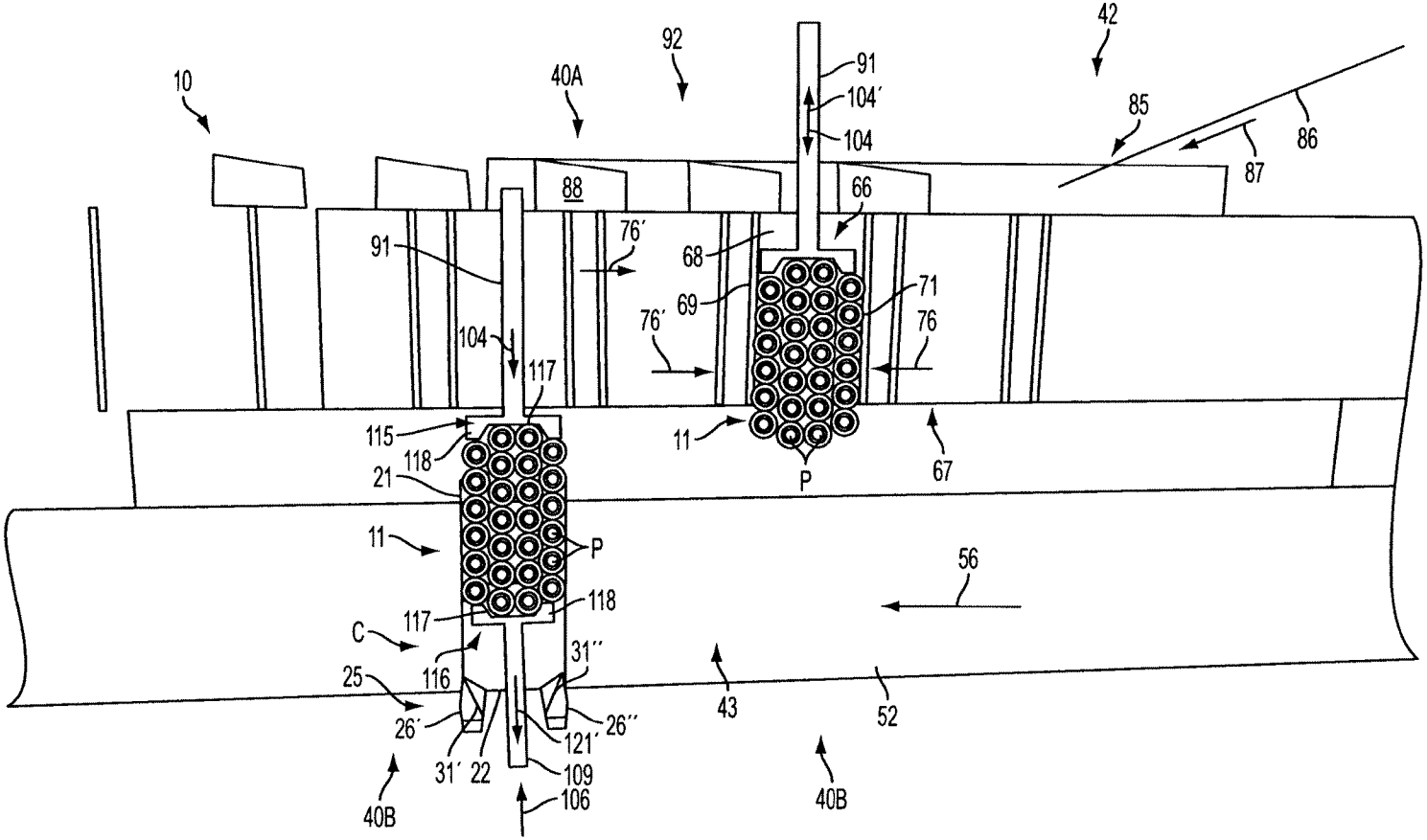
Figure 11E:
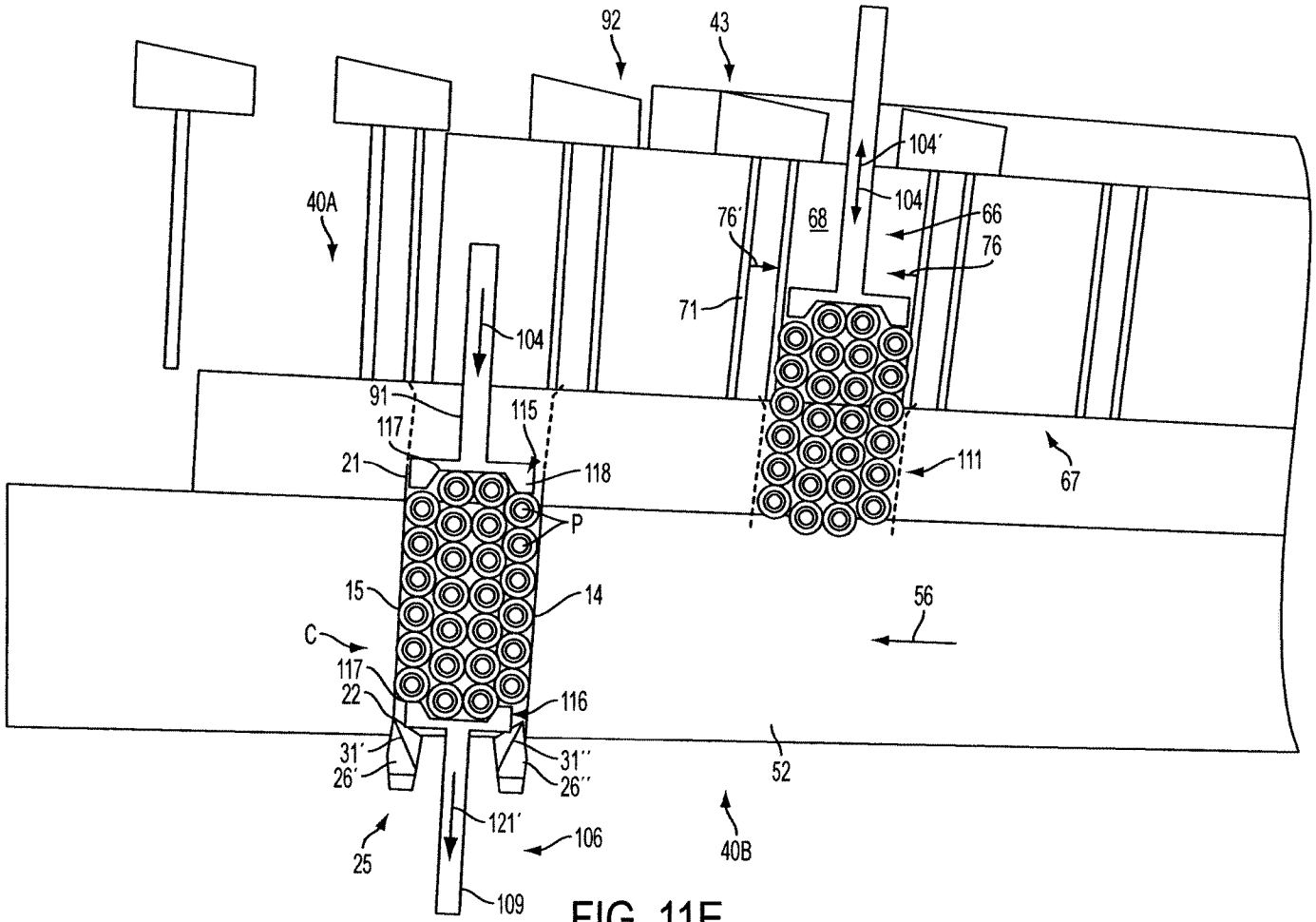
Figure 11F:
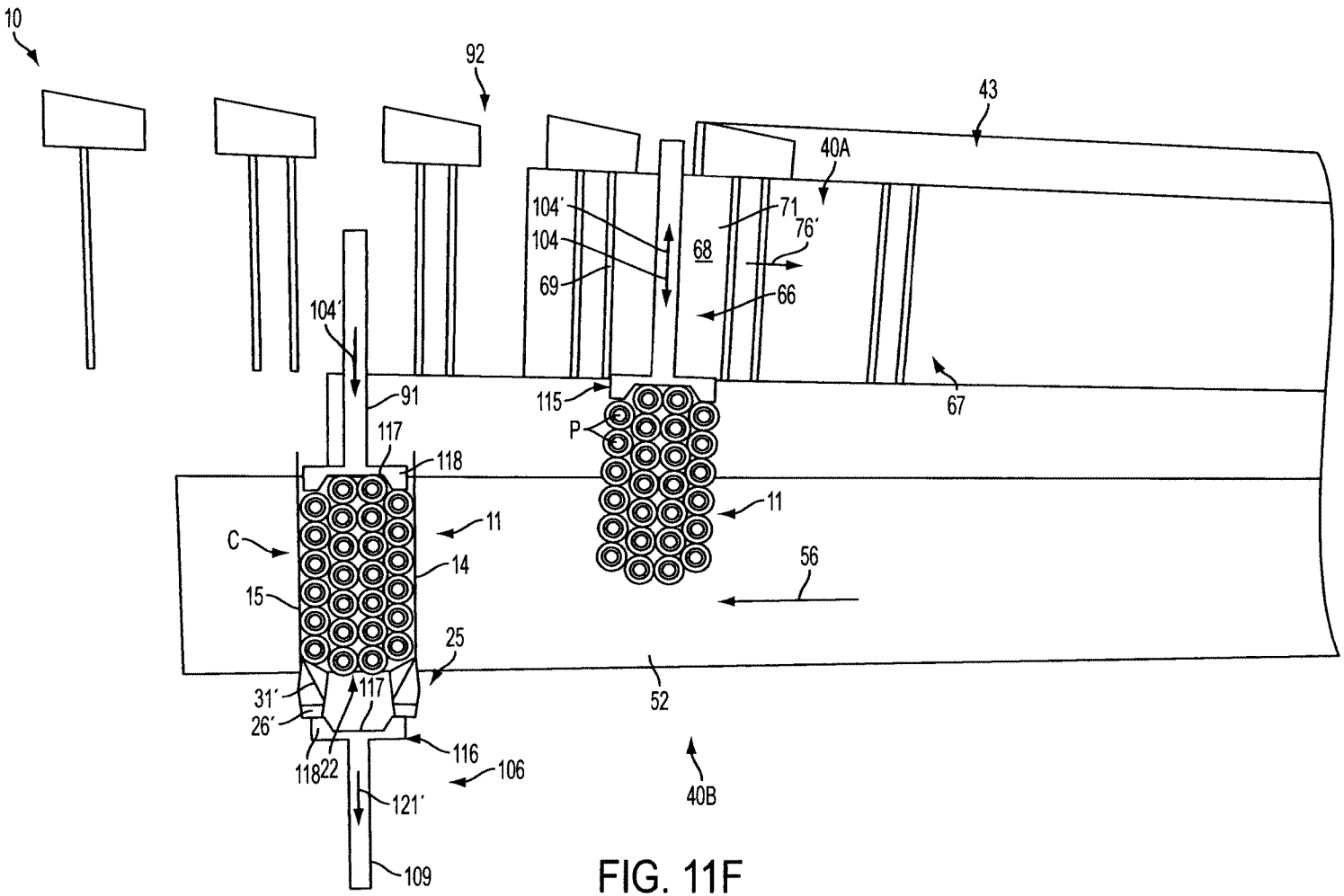
Figure 11G:
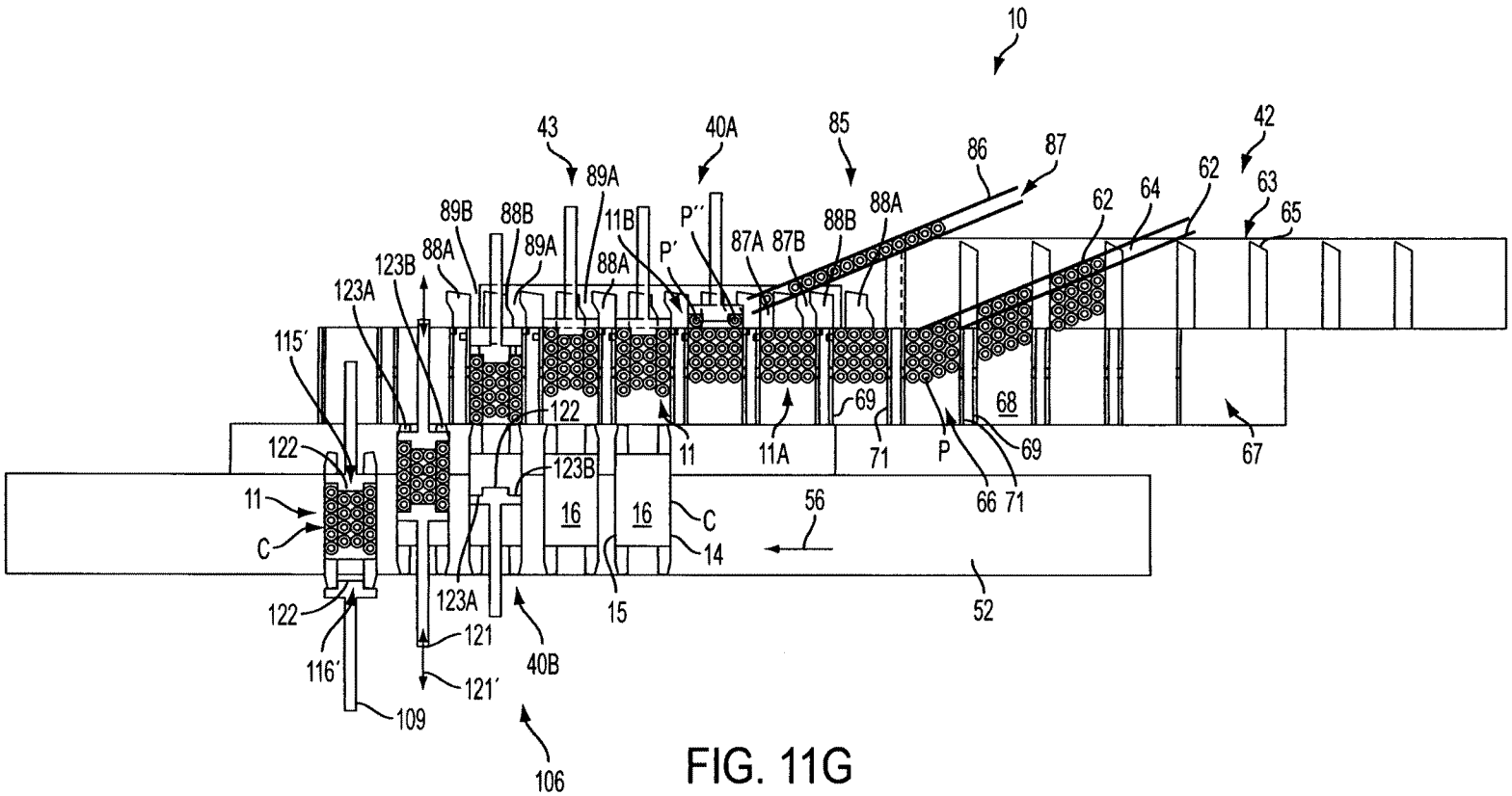

As additionally indicated in FIG. 11G, in one embodiment, a series of funnels or guides 81 further can be provided for assisting with the guiding of the nested product packs or groups 11 into their cartons. The funnels 81 can include upstream and downstream plates 82A-82B that are mounted in spaced series on a conveyor 83. The funnels can be moved in time with the product packs 11, and the positions or spacing between their upstream and downstream plates can be adjusted or varied, depending on the size and/or configuration of the product packs, as needed to facilitate movement of the product packs 11.

As further illustrated in FIGS. 6A-7B, a secondary selector 85 generally is located adjacent the downstream end of the selection and grouping area 42 of the packaging system 10, in a position to receive any additional remaining products not previously selected and loaded into a flight of the selector conveyor by the primary selector 63. Thus, for running more conventional size packs, the secondary selector 85 does not necessarily have to be used. However, for the formation of more non-traditional pack sizes, including nested product packs 11 as illustrated in FIGS. 7A-7B, the secondary selector can receive and select and guide additional series or numbers of products 11B into an engaged or nested relationship with the initial product pack 11A formed on each flight by the primary selector.

As illustrated in FIGS. 6A-6B and 9A-9C, the secondary selector generally will include one or more guides or rails 86 defining at least one lane or passage 87 therebetween, and along which the additional products 11B (FIGS. 9A-9C) are received and guided into a desired nested engagement with the initial product packs 11A formed within the flights of the selector conveyor. As further indicated in FIGS. 7A-7B and 9A-9C, a series of selector wedges 88 can engage the additional series of products being fed by the secondary selector 85 to select and guide or direct the additional products into their nested relationship with the initial product groupings within the flights, as shown in FIGS. 11A-11C. The selector wedges 88 (FIG. 7A) can be mounted on an endless moving belt or conveyor chain, at a desired spacing so as to define guide channels or passages 89 therebetween, and generally will be moved in timed relation with the incoming products moving along the at least one lane 87 of the secondary selector 85 for selecting and metering the products moving therealong. The products will be received within the channels 89 defined between the selection wedges, which will guide such products into nested engagement with their associated initial product groupings 11A to form nested product packs 11.

The resultant product packs 11 can be formed with various numbers and arrangements of rows and of products, arranged in a variety of nested and/or staggered or other configurations. For example, the product packs can have a substantially square or rectangular arrangement with or without gaps at the ends thereof such as shown in FIG. 5E; a generally convex arrangement having additional products at the ends of one or more central or inner rows of products, as shown in FIGS. 5A-5C and 7A; a generally concave arrangement with additional products arranged at the outermost, front and rear, or other rows of products, such as shown in FIGS. 5D and 7B; or other varying package configurations.

As further indicated in FIGS. 6A, 7 and 9A-11F, after each product pack 11 has been formed within a flight 66 of the selector conveyor 67, it will be moved into the loading area or zone 43 of the packaging system 10 for loading into a corresponding carton C. As the product packs 11 move into the loading area, they initially can be engaged by a loader arm 91 of a first, primary or loading assembly 92 mounted along the loading side 40A of the packaging system. The primary loading assembly 92 (FIGS. 9A-10) generally can include two or more drive chains, belts or other conveyors that are moved about an elliptical path of travel in the direction of arrow 94 and which will carry a series of loader arms 91 therealong. The number of loader arms 91 can be varied depending upon the size and/or spacing of the flights of the selector conveyor, with each arm typically moving in timed relation with an associated one of the selector conveyor flights.

Each loader arm 91 generally can include an elongated body or base 96, which also can be formed as a pair of spaced arms or rods 97, attached to a carriage 98 that is slidably mounted on a series of supports 99, such as bars, rods, etc., which in turn are attached to the drive chains or belts 93 of the primary loading assembly. A cam follower 101 (FIG. 9C) can be mounted to the carriage 98 of each loader arm 91 and can engage and ride along a guide track 102, the position of which can be adjusted by an actuator 103, such as a hydraulic or pneumatic actuator or servomotor, or other, similar actuator. This causes the carriage to be urged transversely across the width of the primary loading assembly toward a corresponding product pack being conveyed by the selector conveyor. The position of track 102 thus can be varied to control the transverse movement of the loader arms 91 in the direction of arrows 104/104', into and out of engagement with the product packs as needed for loading the product packs into the cartons, as indicated in FIGS. 7A and 11A-11F.

A second or stabilizing loading assembly 106 also can be mounted on the opposite stabilizing side 40B of the carton conveyor of the packaging system 10 from the primary loading assembly 92. The secondary loading assembly can have a similar construction to that of the primary loading assembly, typically including a conveyor mechanism 107 (FIGS. 9A-9B) that can include one or more belts, chains, etc., and which carries a series of carriages 108 to which loader arms 109 are mounted. A movable guide track 111 can be moved laterally across the path of travel 112 of the carriages and loading arms for controlling the transverse movement of the stabilizing side loader arms 109 toward and away from their associated cartons moving along the carton conveyor.

An example of a loading system that can be used for the primary and/or secondary loading assemblies 92 and 106 of the packaging system 10 can include a split pitch barrel loader such as illustrated and described in U.S. Pat. Pub. No. 2010/0162668 A1, the disclosure of which is incorporated by reference as if fully set forth herein.

As further illustrated in FIGS. 7A and 11A-11F, in one embodiment, the loader arms 91 and 109 each typically will include a forward, pusher face or plate, indicated at 115 and 116, respectively. In one embodiment each pusher face 115/116 of each of the loader arms 91/109 can be formed as a substantially unitary plate, such as indicated in FIGS. 7A and 11A-11F, or alternatively in another example embodiment, can be formed from a pair of side-by-side plates, each attached to a separate arm or rod forming their loader arm. Each pusher face further typically can be configured for engaging various sizes or configurations of product packs 11, including nested product packs. By way of example, in one embodiment, such as for forming a generally concave product pack configuration or arrangement 11 as shown in FIGS. 7A and 11A-11F, the pusher plates or faces 115 and 116 can have substantially U- or C-shaped configurations each with a recessed area 117 defined between a pair of forwardly extending projections or fingers 118. The additional products 11B selected by the secondary selector 85 can be received within this recessed area 117 for supporting the additional products 11B as they are urged into their nested position against the initial group of products 11A as the nested product pack 11 is loaded in the carton.

As also indicated in FIG. 7A, the pusher faces 115 of the loader arms 91 of the primary loading assembly generally can have a lower portion or base 119 which projects downwardly and which is adapted to move over or in close proximity with the upper surface 74 of the base plates 68 of the flights 66 of the selector conveyor as the loader arms 91 move transversely thereacross, in order to engage and substantially stabilize a lower or bottom portion of the products (e.g., bottles as shown in the figures) of the product packs as the product packs are inserted into their corresponding cartons. Conversely, the pusher face 116 of the loader arm 109 of the secondary loading assembly 106 may not require a downwardly extending base or lower portion instead generally engaging an upper or mid portion of the portions, as indicated in FIG. 7A. Still further, the pusher faces of the loader arms can be provided as change-parts to enable quick and easy change out of such pusher faces or plates as needed to accommodate differing size or configuration product packs (such as shown in FIG. 7B) and/or for running more conventional product pack arrangements which do not include a series of additional, staggered or nested products as a part of such product packs.

As schematically illustrated in FIGS. 11A-11F, as the product packs 11 are urged toward and into their corresponding cartons C (in the direction of arrow 104), by the loader arms 91 of the primary loading assembly, the corresponding or associated loader arms 109 of the secondary loading assembly 106 generally will be moved into and through the open interior cavity or passage of the cartons, as indicated by arrow 121 in FIGS. 11A-11C. As a result, as each product pack is inserted into its corresponding carton, it will be engaged from opposite sides thereof to help stabilize and prevent tipping or misalignment of the products as the product packs are seated within their cartons. With the product packs engaged by both loader arms 91/109, movement of the loader arms 109 thereafter can be reversed so as to move in an opposite direction, as indicated by arrow 121' as the loader arms 91 continue their forward movement in the direction of arrow 104 for loading the product packs into their cartons, with the product packs maintained in a stabilized arrangement during loading, as indicated in FIGS. 11D-11E. Thereafter, as indicated in FIG. 11F, once each product pack has been fully seated within its carton, the loader arms of the primary and secondary loading assemblies can be retracted (as indicated by arrows 104' and 121') as the cartons move into the downstream folding/sealing area or zone 44 of the packaging system (FIGS. 1, 2B, 9A-10 and 13A-13B).

In a further, alternative embodiment illustrated in FIGS. 7B and 11G, the secondary selector 85 further can be reconfigured as needed to provide for the selection and feeding of additional, different arrangements of products 11B as needed to form other, varying product pack configurations. For example, as indicated in FIGS. 7B and 11G, the secondary selector can be configured to feed additional product groups 11B in spaced or staggered arrangements into alignment with selected spaced apart rows of the initial product pack 11A, such as being fed into engagement with the outermost or upstream and downstream rows of products. In such an embodiment as shown in FIGS. 7B and 11G, the pusher faces 115' and 116' of the loader arms 91 and 109 of the primary and secondary loading assemblies can be changed and/or configured with a generally A-, E- or substantially T-shaped configuration; for example having a central projecting portion 122 that extends toward the product packs and is bordered by upstream and downstream lateral sections 123A and 123B. The pusher faces 115' and 116' can be provided as change parts so as to replace the pusher faces 115 and 116 of the loader arms 91 and 109, or alternatively, the loader arms themselves can be replaced as needed.

Accordingly, while the secondary selector 85 is being shown in the illustrated embodiments as generally feeding two additional products into engagement with, for example, center rows of the initial product pack, as shown in FIG. 7A, or into engagement with front and rear or foremost and endmost rows of products as shown in FIG. 7B, it will be understood by those skilled in the art that greater or lesser numbers of products also can be fed into engagement or alignment with various selected rows of the initial product pack so as to form substantially rectangular, substantially square, or generally concave and/or generally convex product arrangements. For example, as shown in FIG. 5E, three additional products, such as three additional cans, can be fed into engagement with the first or front row of products, the third or center row of products, and the fifth or last row of products to form a product pack of a desired size and/or shape that can be packaged using a substantially rectangular carton that does not require gussets and additional flaps to substantially conform the carton about the shape of the product pack, such as shown in FIGS. 5A-5C.

In addition, as further illustrated in FIG. 11G, the selector wedges of the secondary selector 85 can be replaced with additional, various configuration selector wedges, such as indicated at 88A and 88B. The selector wedges can be provided with angled guide surfaces 90A-90C, which define an angled or redirecting upstream guide passage 89A, which further can include substantially flat guide surfaces 90D defining a downstream guide passage 89B. It will also be understood by those skilled in the art that other, varying configurations of the selector wedges 88A and 88B, thus defining different and/or additional configuration guide channels 89A and 89B (including additional guide channels as needed) also can be used. The selector wedges 88A and 88B thus will engage the additional products being fed through the secondary selector, and will guide the additional products into a desired nested or staggered, convex or gapped product configuration such as shown in FIGS. 5B, 5E, 7B and 11G.

As discussed above, the loader arms 91 (FIGS. 7B and 11G) of the primary loading assembly will engage and urge the additional products along the guide channels 89A and 89B, into engagement/alignment with selected rows (i.e., the upstream and downstream rows), while at substantially the same time, the downstream wall 71 of each pack reducing flight 66 can be moved toward its upstream wall 79 so as to collapse or reduce the pack size, with the amount of collapse and/or compression of the product pack 11 generally being controlled by the movement of the cam rollers 78 (FIGS. 6A-6B) along the cam track or guide 79. In addition, as also illustrated in FIGS. 7B and 11G, a funnel conveyor 83 can be provided between the flights 66 of the product selector conveyor 67 and the carton conveyor, for moving a series of funnels or guides 81 in timed movement with the product pack 11 across the flights and toward their corresponding or associated cartons. The funnels can further facilitate the compression and guiding each of the product packs 11 into their associated cartons, as needed or desired.

As the product packs are moved by the loader arms 91 of the primary loading assembly toward their cartons, the product packs further can be engaged on the opposite end or side by the loader arms 109 of the second or stabilizing loading assembly 106, the pusher faces 116, of which will generally have a similar configuration so as to matingly engage the product packs from the opposite side to help hold the product packs in their desired nested or staggered arrangement or configuration as the product packs are fed into the openings of their cartons. As noted above, as the product packs enter their associated cartons, the loader arms 109 of the second or stabilizing loading assembly 106 can be retracted as the loader arms 91 of the primary loading assembly 92 continue their forward movement, thus guiding the product packs into their cartons, as discussed above. Thereafter, the cartons, with their product packs loaded therein, will continue along their path of travel into the folding and sealing area of the packaging machine.

The selection and packaging of nested product packs having a substantially concave and/or staggered or gapped arrangements or configurations, such as illustrated in FIGS. 5D, 5E, 7B and 11G, enables the packaging of a variety of different size or number of products in the product packs, i.e., 18, 20, 28, 32, 40 or other differing size pack configurations, which packs further can be packaged using more conventional rectangular or substantially square cartons. Such cartons may not necessarily require additional features such as gussets and/or additional folding flaps at the ends and/or sides thereof in order to more closely configure the carton about concave, oblong or other, similar extended shape product packs such as shown in FIGS. 7A and 11A-11F. As a result, the use of such substantially rectangular or square packages can provide a potential cost savings in the amount of board material required to form the cartons, and can potentially enable increased production/packaging rates.

In addition, as noted, the packaging system 10 (FIGS. 1-3B) and method of operation thereof according to the principles of the present invention further has the flexibility to enable the packaging of more standard or conventional size product packs and/or cartons, for example 12 packs in 2×6, 3×4 configurations, 24 packs in 4×6 configuration, etc. To run such standard or more conventional product packs and cartons, the secondary selector can be disengaged and/or bypassed such that the products being fed on the product infeed conveyor are fed solely to the lanes of the primary selector, and the pusher faces and/or loader arms of the primary and stabilizing loading assemblies can be replaced or changed out with substantially flat front pusher faces for engaging the product packs and urging the product packs into their associated cartons. In addition, in running such generally standard or more conventional size product packages or cartons, if it is not needed or desired to compress or reduce the size of the product packs, the cam track guiding the cam rollers of the pack reducing flights 66 of the selector conveyor can be removed or moved or shifted to a position or location out of engagement with the cam rollers to avoid compression or reduction in size of the product packs. As a further alternative, the secondary selector can be maintained in operation, and can be used to selectively feed additional products in conjunction with the primary selector. For example, if the primary selector is feeding four to six rows, such as for forming a 12 or 24 pack, the secondary selector can be operated in conjunction with the primary selector to feed an additional row or rows as needed to form additional, larger size product packages.

Figure 12A:
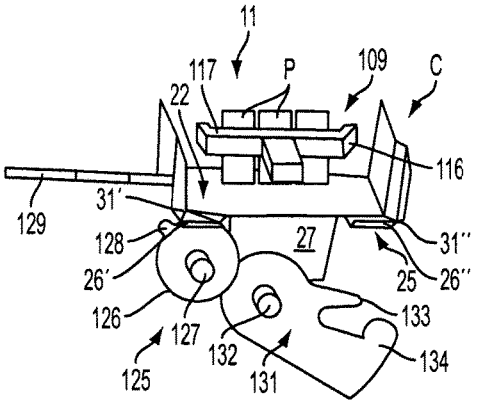
FIGS. 12A-12E are schematic illustrations showing the progressive tucking and folding of the lower end flaps of the stabilizing side of the carton by the upstream folding and tucking mechanism.
Figure 13A:
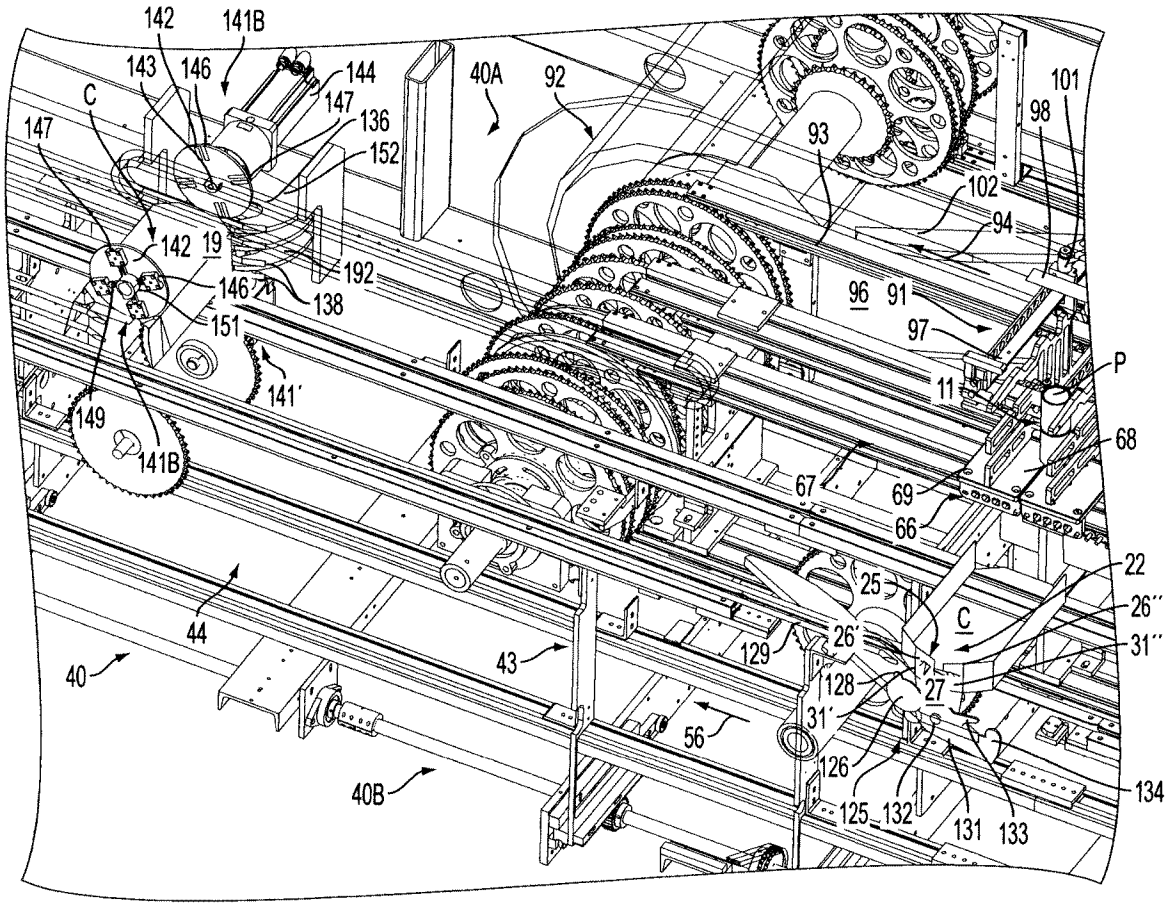
FIGS. 13A-13D are schematic illustrations of an example embodiment of the folding and tucking mechanisms of the folding/sealing area of the packaging system.
Figure 13B:
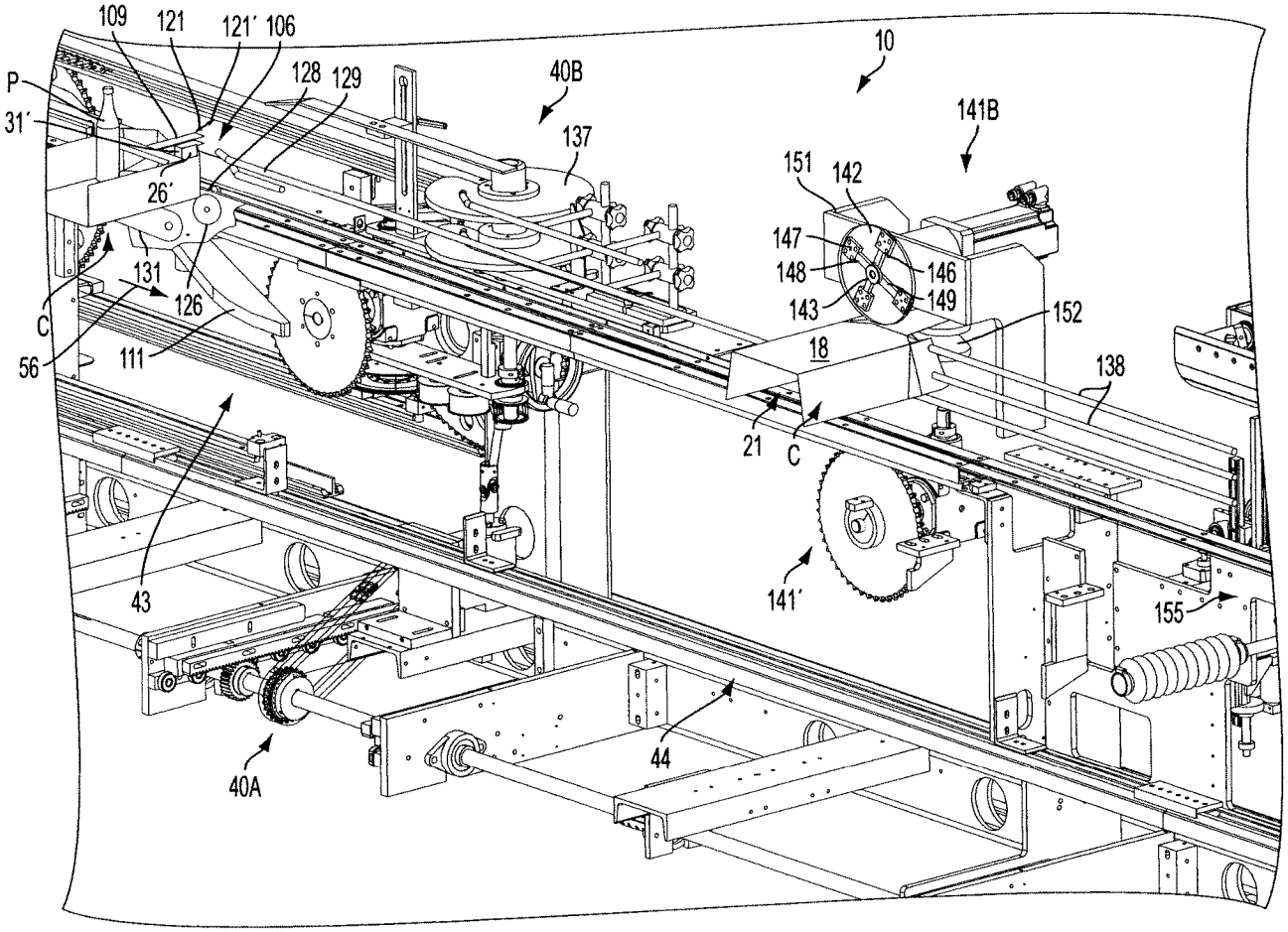

As illustrated in FIGS. 11E-11F, with the product packs seated in their cartons, the loader arms of each of the loading assemblies thereafter can be retracted or removed from the cartons and out of engagement with the product packs therein, after which, or in conjunction with which, the open ends of the cartons can be closed and sealed as the cartons continue along their path of travel into the holding/sorting area 44. As indicated in FIG. 13A, as the cartons enter the folding/sealing area 44, they typically will be engaged by a first, upstream folding/tucking mechanism 125. The upstream folding/tucking mechanism 125 generally can be located adjacent a downstream end of the secondary loading assembly 106 so as to engage the lower end flaps 26 and lower gussets 31 of the cartons C along the second or stabilizing side 40B of the packaging system to initiate the closing of the cartons along the stabilizing sides thereof, while the loader arm 109 of the secondary loading assembly 106 generally can remain in contact or stabilizing engagement with the end most products P of the product pack 11 loaded thereon, as indicated in FIGS. 12A, 13A and 13B. Thus, the closing of each carton for sealing its product pack therein can be initiated while the product packs are maintained in their stabilized engagement between the loading arms of the primary and secondary loading assemblies.

As noted above, the pusher plate 116 of the secondary loader arm 109 generally can be formed or configured so as to engage intermediate and/or upper portions of a product pack so as to enable the secondary loader arm 109 to remain in its stabilizing contact with the products during folding and closing of the lower end flaps of the cartons along their secondary or stabilizing sides, after which the secondary loader arm 109 can be fully retracted from the carton without interfering with the closing of the lower end flaps of the carton. Once closed, the lower end flaps of the carton thereafter can provide the desired or necessary stability for the product packs contained within their cartons as the remaining end flaps along both sides of the cartons are closed and sealed.

Figure 12B:
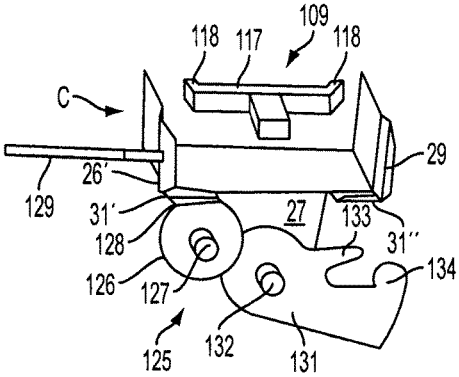
Figure 12C:
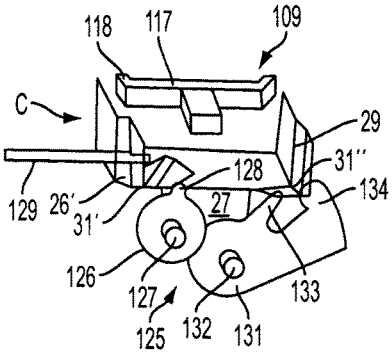
Figure 12D:
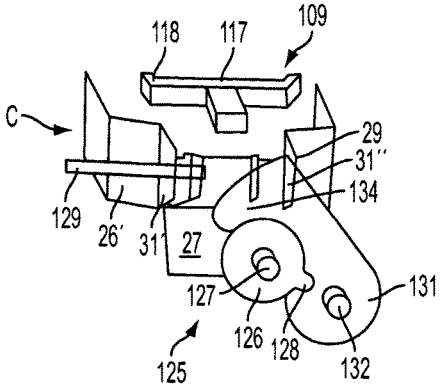
Figure 12E:
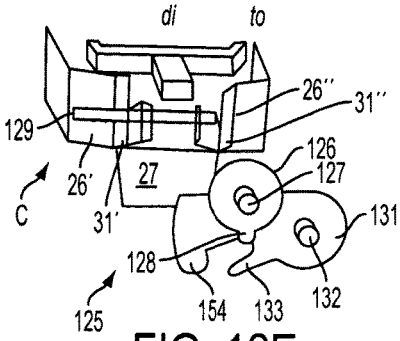

FIGS. 12A-12E schematically illustrate the operation of the upstream folding/tucking mechanism 125 for folding and tucking the lower end flaps and lower gussets of the cartons along their secondary or stabilizing side. As indicated in FIGS. 12A-13B, the initial folding/tucking mechanism 125 generally will include a tucking wheel 126 mounted on a driveshaft 127 and including a radial projection or tucking finger 128 located along the circumference thereof. The tucking wheel 126 generally will be rotated, such as under the control of a drive motor or by being linked to the drive system for the carton conveyor or other operative conveying elements of the packaging system so as to be rotated into engagement with the leading lower gusset 31' of each carton, as indicated in FIGS. 12A and 12B. The rotation of the tucking wheel causes the leading lower gusset to bend or fold inwardly, as indicated in FIGS. 12B-12E, while at the same time the leading lower end flap 26' of each carton will be engaged by one or more guide rods 129, as indicated in FIGS. 12A-13B, to cause the movement of the leading lower end flap of such a carton to its folded or closed position as shown in FIGS. 12D and 12E.

At approximately the same time, an upstream tuck and fold member 131 can similarly engage the trailing lower end flap 26" and gusset 31" of the carton, as indicated in FIGS. 12C-12E. The tuck and fold member 131 generally is mounted on a driveshaft 132, which rotates the tuck and fold member into engagement with the downstream or trailing lower gusset and end and/or side flaps of each carton, and can include an elongated tucking finger or projection 133 that helps urge the trailing lower gusset inwardly, and hooked upper engaging end 134 that engages and urges the trailing lower end and/or side flaps toward their folded configuration shown in FIG. 12D. As the tuck wheel 126 and tuck and fold member 131 of the upstream or initial fold/tuck mechanism 125 are rotated out of engagement with the gussets and end flaps of the cartons, the end flaps of the cartons thereafter will continue along the guide rods 129 will maintain the lower end flaps of the cartons in their folded/closed position as indicated in FIG. 12E. Such engagement further helps provide stability to that end of the product pack within the carton.

Figure 13C:
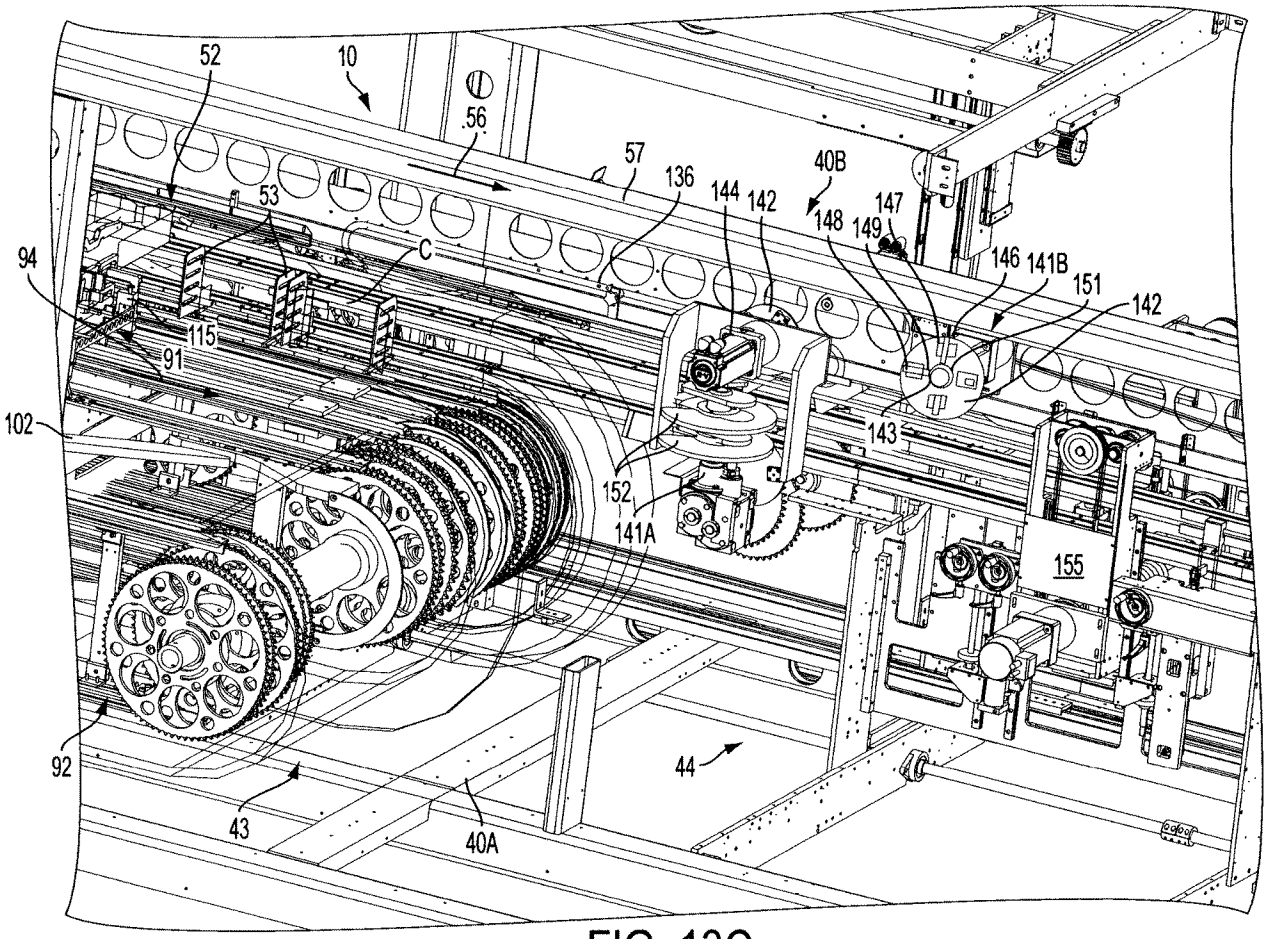
Figure 13D:
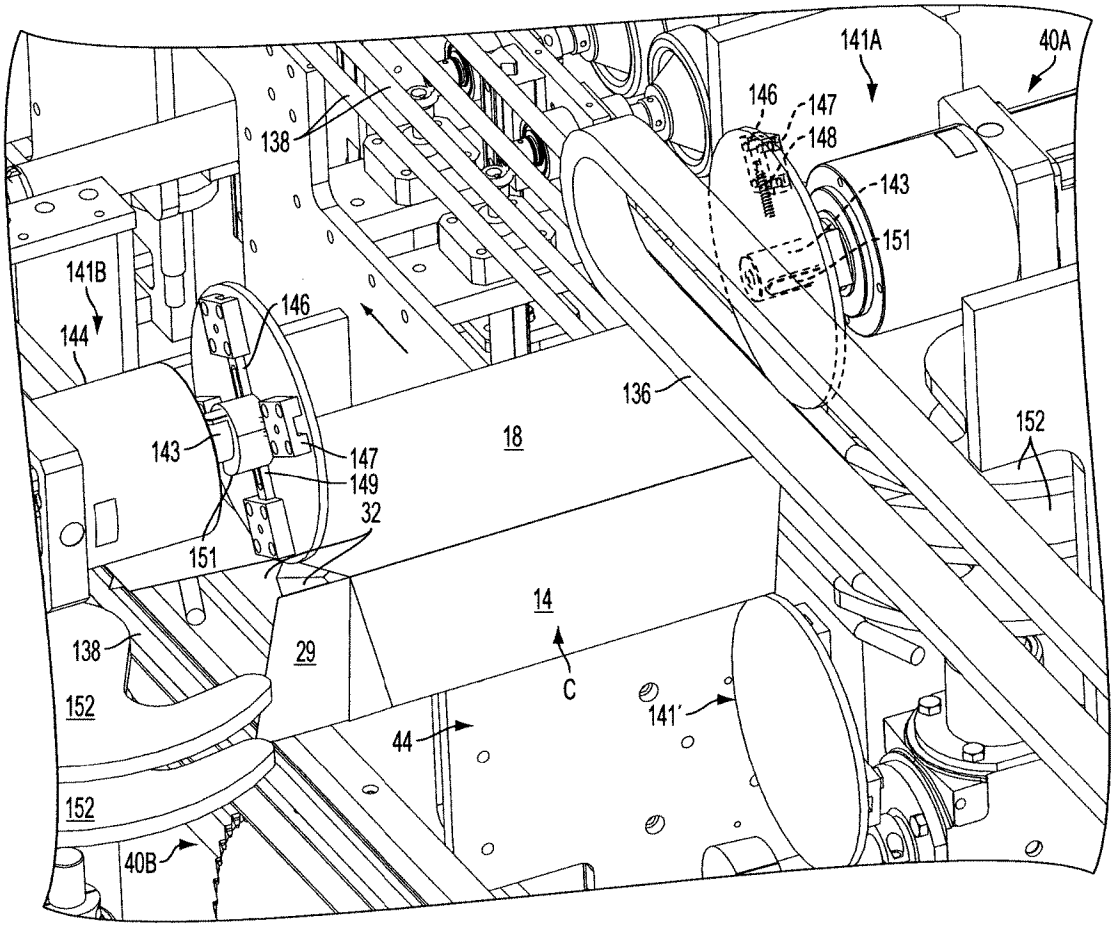
Figure 14:
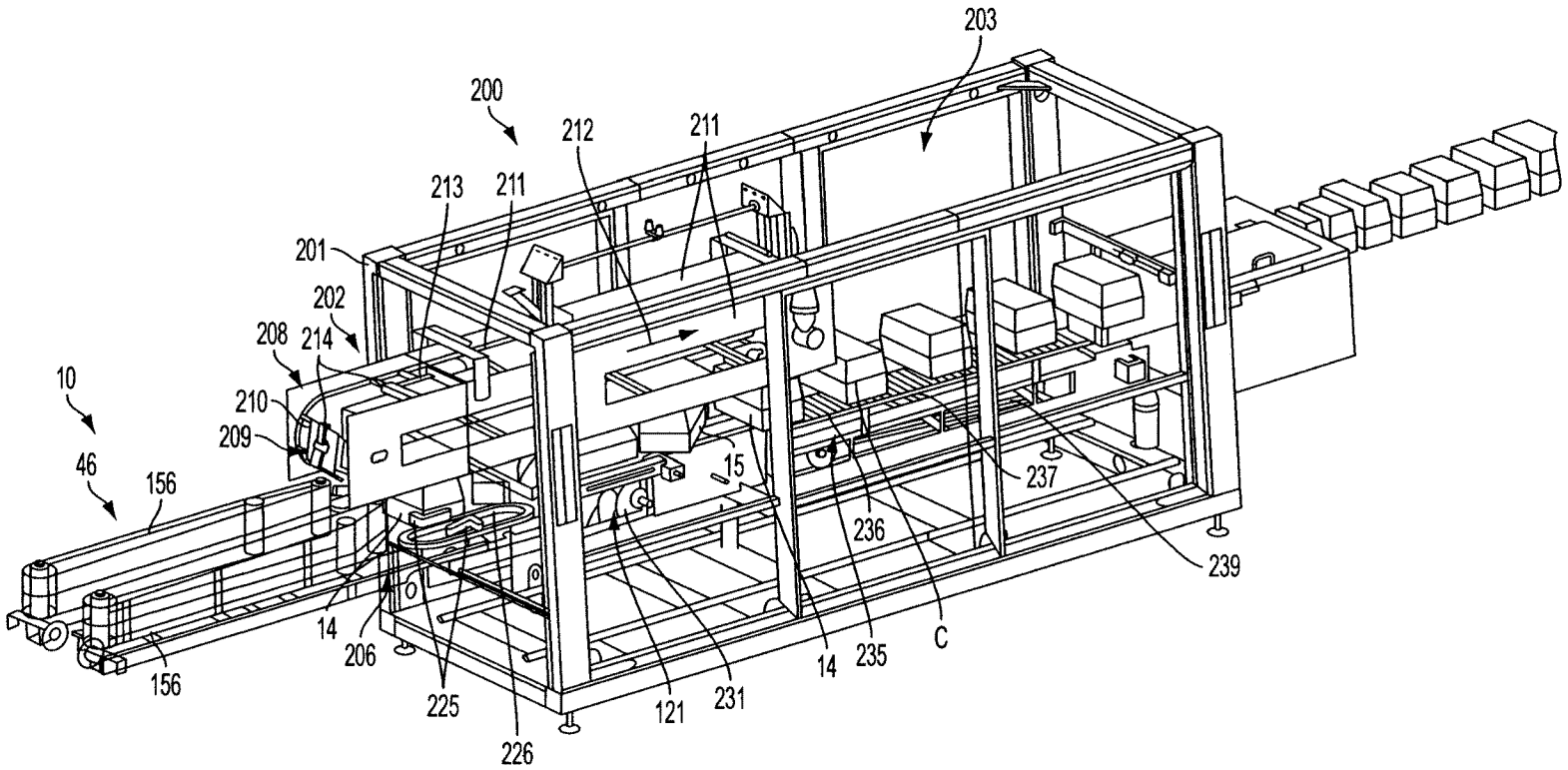
FIG. 14 is a perspective illustration of one example embodiment of a turner/divider station for use with the packaging system according to the principles of the present invention.

While the guide rods 129 provide stability and support to the end of the product packs along the stabilizing or second side 40B of the packaging system, the cartons also can be engaged by a control belt 136 along the loading side 40A thereof, as indicated in FIGS. 13A, 13C and 13D, to help provide additional stability to the product packs within the cartons as the first or primary loader arms are fully retracted therefrom. The control belt 136 can be a foam belt or similar cushioned belt formed from a non-stick or non-marring material so as to avoid damaging the cartons as the cartons are moved therealong. The control belt can be driven or moved at a speed commensurate with the movement of the cartons along their path of travel, and can apply a downward compression force against the upper surfaces of the cartons. This downward compression force can help create a frictional engagement between the top surfaces of the cartons and the products of the product pack contained therein to help provide additional stability to the product packs adjacent the loading ends of the cartons until the loading ends of the cartons can be closed and sealed.

As the cartons proceed through the folding/sealing area 44, as indicated in FIGS. 13A-13C, the side flaps along the ends of the cartons and lower end flaps along the loading sides of the cartons generally can be engaged by a folding mechanism, such as folding wheels 137, mounted on each side of the path of travel of the cartons, as well as by a series of guide rails 138 to maintain the folded side and upper end flaps of the cartons in their folded and closed positions. Thereafter, the cartons typically will be engaged on each side thereof by a pair of downstream folding/tucking mechanisms 141A and 141B (FIGS. 13C and 13D). Each of the downstream folding/tucking mechanisms 141A and 141B can include a rotating folding wheel 142 mounted to a driveshaft 143 and rotated with the movement of the cartons thereby by an actuator such as a servomotor, stepper motor or other, similar drive 144. A series of tucking fingers 146 are extensibly mounted within brackets 147 along a rear side surface of each folding wheel 142. Each of the tucking fingers generally will be biased toward a retracted position by a spring or similar biasing mechanism 148, with the lower or interior ends 149 of the tucking fingers 146 generally being rotated over or moving about a cam surface 151 mounted along the driveshaft 143 so as to cause the tucking fingers to be moved between extended and retracted positions.

In their extended positions, the tucking fingers will engage the upper gussets of the cartons so as to urge the upper gussets toward an inwardly folded position as an additional set of folding wheels 152 engage and urge the upper end and side flaps toward a folded, closed position and the top end flaps are engaged by the folding wheels and urged to their folded, closed position. Additionally, the lower or bottom end flaps of each of the cartons likewise can be engaged and urged toward folded and closed position by lower folding/tucking mechanisms 141'. Each lower folding/tucking mechanism can have a similar construction to the upper to folding/tucking mechanisms 141A/141B but will be positioned below the path of travel of the cartons in a position to engage and fold the bottom end panels.

Thereafter, as indicated in FIGS. 1, 2B and 3A-3B, the cartons, with their end flaps folded to a closed position, can be moved through a series of glue or adhesive applicators 155, which will apply an adhesive material thereto, for sealing the ends of the cartons. The cartons can be sealed with their bottom end flaps overlapping their top end flaps, or alternatively with their top end flaps overlapping the bottom end flaps thereof as needed or desired depending upon the configuration of the cartons and additional concerns, such as whether a handle or strap is provided therewith. The cartons are then received within the compression section 46 of the packaging system 10, passing between compression belts 156 that generally will engage and apply a compressive force against the ends of the cartons to complete the closure and sealing of the cartons.

In addition, if the cartons are provided with a series of article protection features 19 formed integrally therein, as shown in FIG. 5C, the cartons can be engaged by one or more actuators for activating such article protection features as the cartons are fed along the compression section of the packaging system between the compression belts 156. Such actuators can include rotating punches or similar systems or devices such as disclosed in U.S. patent application Ser. No. 13/655,527, the disclosure of which is incorporated by reference as if fully set forth herein.

After the product packs 11 (including nested product packs) have been formed, loaded and sealed within their cartons, in one embodiment, the finished cartons can be offloaded for storage and/or transport. In another embodiment, as illustrated in FIGS. 14-17, the cartons C alternatively can be fed into a downstream turner/divider station 200. For example, with some carton constructions, it may not be practical to engage and form any or all of the article protection 19" features provided therein within the compression section of the packaging system, i.e., for larger packages as shown in FIG. 5C, it may be desirable to include a row of article protection features formed along the center-line or longitudinal axis 20 thereof. Such cartons accordingly can be fed into the turner/divider station 200 (FIG. 14) wherein the cartons can be rotated in order to enable the activation of such article protection features oriented along their longitudinal/center-line axis.

Figure 15:
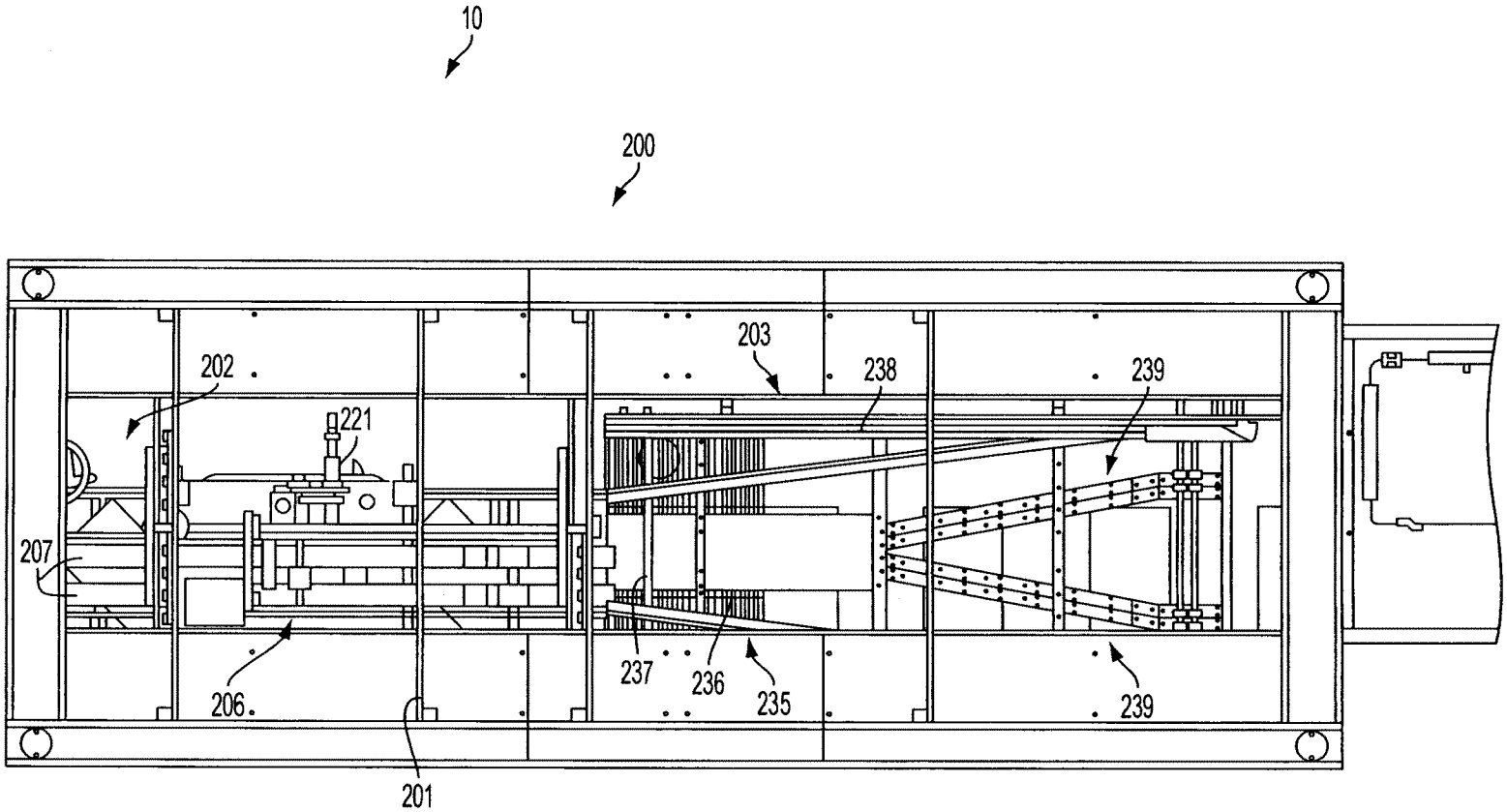
FIG. 15 is a bottom view of the turner/divider station of FIG. 14.
Figure 16:
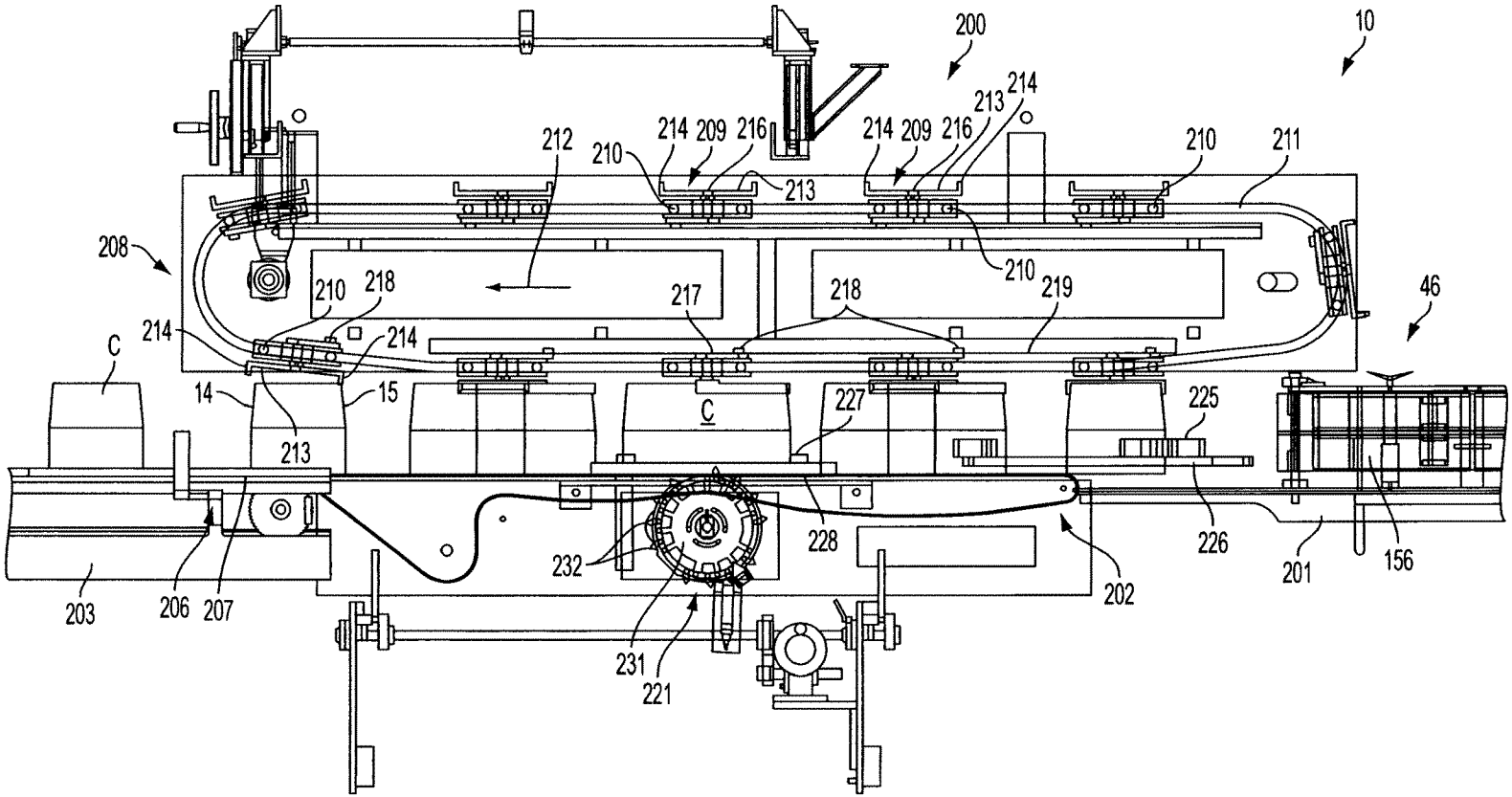
FIG. 16 is a side elevational view, with parts removed, illustrating the turning of the cartons and their engagement by a rotating punch assembly for activating a series of article protection features within the cartons.
Figure 17:
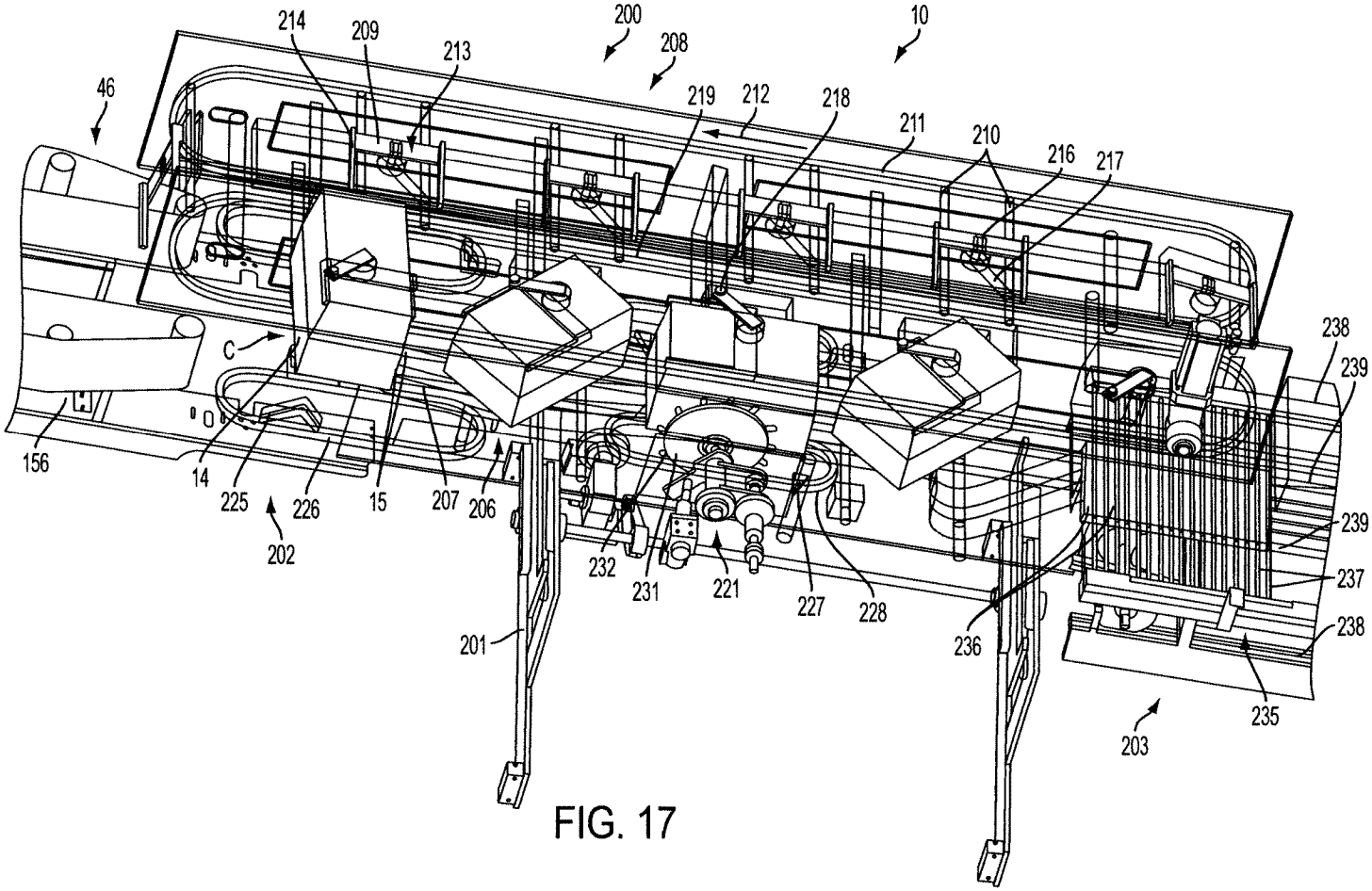
FIG. 17 is a schematic illustration of the turning of the cartons for engagement and activation of the article protection features within the turner/divider station of FIG. 14.

As further indicated in FIGS. 14-17, the turner/divider station 200 can be mounted to the packaging system 10 as a downstream section or station thereof, or alternatively, can be formed as a separate, stand-alone station. As FIG. 14 indicates, the turner/divider station 200 can be positioned inline with the compression belts 156 of the compression section 46 of the packaging system 10 so as to receive the loaded/enclosed cartons C directly therefrom. The turner/divider system generally will include a framework or housing 201 having a turning section 202 and a dividing section 203 defined therealong. The turning section 202 generally can include a conveyor 206, which can include a pair of spaced conveyor belts 207 (FIG. 15) or other, similar conveying mechanism having non-stick surfaces to facilitate the rotation or turning of the cartons thereon as indicated in FIGS. 16 and 17.

An overhead turning mechanism 208 can be mounted to the frame 201 of the turner/divider station 200, supported above the conveyor 206. The overhead turning mechanism 208 can include a series of plates 209 mounted along a series of guide rods 210 that are driven by conveyor belts or chains 211 about an elliptical path of travel into engagement with the cartons and which move the cartons through the turning section 202 as indicated by arrows 212. Turning arms 213 generally will be mounted to the plates 209 and will be carried thereby into engagement with the top or upper surfaces 18 of the cartons C, as indicated in FIGS. 16 and 17. Each of the turning arms also generally can include downwardly projecting portions or lugs 214, which can be adjustably spaced so as to be adapted to fit varying size cartons and which will engage upstream and downstream side walls 15/14 of the cartons, respectively.

The turning arms 213 further can be connected via a rotating shaft or pin 216 to a linkage 217 having a cam roller or follower 218 mounted to a distal end thereof. The cam follower 218 of each linkage 217 generally will engage a cam track 219 formed about the overhead turning mechanism as the plates 209 are rotated along their path of travel. As the cam followers of the turning arms move along the cam track, the responsive movement of the linkage 217 causes the turning arms 213 to be rotated, which rotational movement correspondingly is transmitted to the cartons, causing rotation of the cartons to a desired orientation as indicated in FIGS. 16 and 17. In one embodiment, the cartons can be rotated approximately 90° so as to realign the longitudinal axis 20 thereof in order to position or locate the cartons as needed for engagement of the article protection features thereof by a rotating punch mechanism 221, or similar actuator, as discussed above, for activating the article protection features extending along the longitudinal/center-line axes of the cartons. Other, greater or lesser rotations also can be provided as needed or desired.

As additionally indicated in FIG. 17, as the cartons enter the turner/divider station 200, the cartons can be engaged on either side thereof by a series of lugs 225 carried by belts or chains of an initial conveying mechanism 226. The lugs 225 help urge or move the cartons C along their path of travel onto and along the belts 207 of the turning section conveyor 206. As the clamp arms begin to rotate or reorient the cartons, the lugs 225 can be moved away from engagement therewith. After the cartons have been rotated by a desired amount, the cartons can further be engaged by a series of downstream lugs or pushers 227 mounted long belts, chains or other conveying mechanisms of a secondary conveyor 228. The downstream lugs 227 of the secondary conveyor 228 will engage and urge the cartons along the belts 207 of turning section conveyor 206 as the punch mechanism 221 engages the cartons.

While FIGS. 16 and 17 illustrate the punch mechanism 221 as generally including a rotating wheel 231 having a series of fingers, punches or other projections 232 mounted in spaced series about the circumference of the wheel 231, it will be understood that other, varying mechanisms for engaging the cartons and activating the article protection features therein also can be used. Once the centerline row of article protection features of the cartons has been activated or formed therein, the cartons can be reoriented or rotated back to their initial orientation, or can be rotated into another orientation as needed or desired, as shown in FIGS. 16 and 17.

Thereafter, the cartons will be passed to the dividing section 203 of the turner/divider station 200 as the turning arms of the overhead turning mechanism are rotated out of engagement with the cartons. As FIGS. 15 and 17 illustrate, the dividing section 203 generally will include a conveying mechanism 235 that can comprise a series of slats or carrier plates 236 slidably mounted along rails 237, the ends of which are mounted to belts, chains or other similar conveying elements, as indicated at 238. As shown in FIG. 15, the dividing section 203 can be separated or arranged with two or more lanes 239 formed therealong. As the cartons are conveyed forwardly through the dividing section, the cartons can be divided and directed into multiple lanes as needed or desired. To divide the cartons into the lanes, the groups of slats supporting each of the cartons can be controlled so as to be moved laterally along their support rails 237, resulting in the cartons being separated and divided into the two or more lanes 239 provided along the dividing section. The cartons thereafter can be collected for storage and/or transport as will be understood by those skilled in the art.

It will be understood by those skilled in the art that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same invention is directed, and it will be understood that any methods and materials similar or equivalent to those described herein can be used in the practice or construction of the invention.

The foregoing description generally illustrates and describes various embodiments of the present invention. However, it will be understood by those skilled in the art that various changes can be made to the above-discussed construction without departing from the spirit and scope of the present invention as disclosed herein, and that it is further intended that all matter contained in the above description or shown in the accompanying drawings shall be interpreted as illustrative, and not in a limiting sense. Furthermore, the scope of the present disclosure shall be construed to cover various modifications, combinations, alterations, etc., of the above-described embodiments, which shall be considered to be within the scope of the present invention. Accordingly, various features and characteristics of the present invention as discussed herein may be selectively interchanged and applied to other illustrated and non-illustrated embodiments of the present invention.

The invention claimed is:

1. A method of packaging products, comprising:
moving products along a product infeed;
selecting products and forming an initial product pack within flights of a selector conveyor moving along a path of travel;
selecting one or more additional products with a secondary selector and directing the one or more additional products into engagement with the initial product pack within the flights of the selector to form a staggered or nested product pack;
engaging the staggered or nested product pack from a first side with a loader arm of a first loading assembly and urging the staggered or nested product pack toward a carton;
engaging the staggered or nested product pack from a second, opposite side with a loader arm of a second loading assembly such that the staggered or nested product pack is captured between the first and second loader arms;
moving the first and second loader arms in a same direction across the path of travel and into the carton so as to move the staggered or nested product pack captured therebetween into a load position within the carton;
retracting the loader arms from the carton; and
engaging and closing an open end of the carton.

2. The method of claim 1, wherein the staggered or nested product pack comprises a substantially convex or a substantially concave pack configuration.

3. The method of claim 1, wherein selecting the one or more additional products comprises engaging the one or more additional products with a plurality of selector wedges, the selector wedges defining guide passages therebetween that are configured to guide the one or more additional products into engagement with selected rows of products of the initial product pack to form the staggered or nested product pack.

4. The method of claim 1, further comprising moving the carton through a turning station after closing the open ends thereof.

5. The method of claim 1, further comprising compressing the staggered or nested product pack prior to engaging the staggered or nested product pack with the loader arms of the first and second loading assemblies.

6. The method of claim 5, wherein compressing the staggered or nested product pack comprises moving at least one wall of the flights within which the staggered or nested product pack is formed against the staggered or nested product pack so as to compress the product packs against an opposite wall of the flights.

7. The method of claim 1, further comprising actuating a series of article protection features into engagement with one or more products of the staggered or nested product pack within the carton.

* * * * *